US005757255A

United States Patent [19]

Noda et al.

[11] Patent Number: 5,757,255

[45] Date of Patent: May 26, 1998

[54] ELECTROMAGNETIC RELAY

[75] Inventors: Masayuki Noda, Takatsuki; Takeshi Suzuki, Kyoto; Takashi Noguchi, Nagaokakyo; Tatsuo Shinoura, Takatsuki; Takashi Asao, Kusatsu, all of Japan

[73] Assignee: Omron Corporation, Kyoto, Japan

[21] Appl. No.: 700,456

[22] PCT Filed: Mar. 10, 1995

[86] PCT No.: PCT/JP95/00405

§ 371 Date: Sep. 11, 1996

§ 102(e) Date: Sep. 11, 1996

[87] PCT Pub. No.: WO95/25336

PCT Pub. Date: Sep. 21, 1995

[30] Foreign Application Priority Data

Mar. 15, 1994 [JP] Japan ..... 6-043973

[51] Int. Cl.[6] ..... H01H 51/22

[52] U.S. Cl. ..... 335/78; 335/129; 335/202

[58] Field of Search ..... 335/78–86, 106, 335/107, 127–131, 202

[56] References Cited

U.S. PATENT DOCUMENTS

| | | | |
|---|---|---|---|
| 5,160,910 | 11/1992 | Tsuji | 335/129 |
| 5,202,663 | 4/1993 | Tomono et al. | 335/86 |
| 5,239,281 | 8/1993 | Tomono et al. | 335/78 |
| 5,289,144 | 2/1994 | Liao | 335/78 |

FOREIGN PATENT DOCUMENTS

| | | |
|---|---|---|
| 58-133247 | 9/1983 | Japan . |
| 403152819A | 6/1991 | Japan . |
| 5-15285 | 2/1993 | Japan . |

*Primary Examiner*—Michael L. Gellner
*Assistant Examiner*—Raymond Barrera
*Attorney, Agent, or Firm*—Morrison & Foerster LLP

[57] ABSTRACT

In an electromagnetic relay in which a contact mechanism 50 provided on a base 10 is driven by a card 60 which slides and moves in parallel to the axis of an electromagnet block 20 provided in the base 10 as the electromagnet block 20 is magnetized and demagnetized, the base 10 comprises a guide portion 17 for restricting the card 60 in its position. This prevents variations in the performance characteristics so that high productivity and long service life of contacts can be obtained.

7 Claims, 26 Drawing Sheets

ELECTROMAGNETIC RELAY

TECHNICAL FIELD

The present invention relates to an electromagnetic relay superior in insulating characteristic and, more particularly, to its card supporting structure and contact mechanism.

BACKGROUND ART

An electromagnetic relay superior in insulating characteristic according to the prior art is shown in FIGS. 25 and 26 as an example.

In this electromagnetic relay, a cylindrical frame 1*a* with one side closed is formed integrally with a base 1 at a generally central portion of the base 1. Into a cavity 1*b* of the cylindrical frame 1*a*, an electromagnet block 2 to which a moving core 3 is assembled rockable via a hinge spring 4 is inserted sideways along the axial direction, while fixed contact terminals 5, 6 and a movable contact terminal 7 are inserted and fixed sideways. Then, a pair of elastic arms 8*a*, 8*a* provided at one end of a card 8 are engaged with engagement recesses 3*a*, 3*a* of the moving core 3, while a pair of projections 8*b*, 8*b* provided at the other end of the card 8 are engaged and assembled with engagement recesses 7*d*, 7*d* of an elastic contact member 7*c* forming the movable contact terminal 7. In this way, the card 8 is supported so as to be reciprocatingly movable in parallel to the axial direction of the electromagnet block 2. In addition, reference numeral 9 denotes a casing fittable to the base 1, and the contact terminals 5, 6 and the movable contact terminal 7 have fixed contacts 5*b*, 6*b* and a movable contact 7*b*, respectively, provided at high locations away from their terminal portions 5*a*, 6*a* and terminal portion 7*a*.

When the moving core 3 rocks by its being attracted to or separated from an iron core 2*a* of the electromagnet block 2 with the electromagnet block 2 energized or de-energized, the card 8 resultantly moves reciprocatingly so that the other end 8*c* thereof presses and releases the top end portion of the elastic contact member 7*c*. As a result, the movable contact 7*b* contacts and separates from the fixed contacts 5*b*, 6*b*, alternately, whereby the circuit is opened and closed.

However, the electromagnetic relay according to the prior art has the following three technical problems.

As a first technical problem, according to the prior art electromagnetic relay, the assembly of the card 8 to the movable contact terminal 7 involves a process of forcedly bending the elastic contact member 7*c* outward.

This would cause the elastic contact member 7*c* to undergo some plastic deformation, which would often incur variations in performance characteristics.

Also, the aforementioned electromagnetic relay involves many assembling operations so that it takes time and labor for the card 8 to be assembled to the elastic contact member 7*c*, resulting in low productivity.

Further, in the aforementioned electromagnetic relay, not only the drive-use projection 8*c* presses the elastic contact member 7*c*, but also a pair of the projections 8*b*, 8*b* are engaged with the engagement recesses 7*d*, 7*d* of the elastic contact member 7*c*. Therefore, variations in the assembly precision would make it likely that the drive-use projection 8*c* makes skew contact with the elastic contact member 7*c* as the card 8 moves reciprocatingly. This leads to a problem that the movable contact 7*b* of the movable contact terminal 7 makes nonuniform contact with the fixed contacts 5*b*, 6*b* of the fixed contact terminals 5, 6 such that the fixed contacts 5*b*, 6*b* are accelerated to wear and shortened in service life.

In the light of the aforementioned first technical problem, a first object of the present invention is to provide an electromagnetic relay which is free from variations in performance characteristics, high in productivity, and long in contact service life.

As a second technical problem, according to the prior art electromagnetic relay, the electromagnet block 2 is inserted sideways along the axial direction into the cavity 1*b* of the frame 1*a* provided in the base 1, wherein ahead in the insertion direction, arranged are the fixed contacts 5*b*, 6*b* and the movable contact 7*b* partitioned by the frame 1*a*. Therefore, whereas the assembly precision of the electromagnet block 2 with respect to the base 1 directly affects the move extent of the card 8, there is a difficulty in assembling the electromagnet block 2 to the base 1 with high precision, such that variations in the performance characteristics often occur.

Also, the base 1 needs to be molded integrally with the frame 1*a*, and therefore has a complex configuration. This makes the molding process difficult as well as the manufacture of the mold also difficult.

Further, the electromagnet block 2 needs to be inserted into the base 1 sideways along the axial direction, a direction other than that in which the other components are assembled. As a result, the automatic assembling machines become complex to arrange in the assembly line, which leads to a problem that the automatization of assembly processes demands more tasks.

In the light of the aforementioned second technical problem, a second object of the present invention is to provide an electromagnetic relay which is free from variations in performance characteristics, and which allows easy accomplishment of required molding work, manufacture of molds, and automatization of assembly.

As a third technical problem, according to the prior art electromagnetic relay, since the fixed contacts 5*b*, 6*b* and the movable contact 7*b* are located at high positions away from the top surface of the base 1, the fixed contacts 5*b*, 6*b* and the movable contact 7*b* may result in large deflections even when the fixed contact terminals 5, 6 and the movable contact terminal 7 are slightly inclined by thermal deformation of the base 1 due to elevated outside temperature. Therefore, the performance characteristics tend to vary due to shifts of the fixed contacts 5*b*, 6*b* and the movable contact 7*b* relative to each other.

Further, since the elastic contact member 7*c* has only a short effective length, the elastic contact member 7*c* needs to be reduced in thickness in order to ensure a specified spring constant. Therefore, the elastic contact member 7*c* tends to deform during the process of caulking or other fixing work, which leads to a problem of troublesome assembly work.

In the light of the aforementioned third technical problem, a third object of the present invention is to provide an electromagnetic relay which will not vary in performance characteristics even with varying outside temperature, and which is easy to assemble.

DISCLOSURE OF THE INVENTION

To achieve the first object, in a first characteristic aspect of the present invention, there is provided an electromagnetic relay in which a contact mechanism mounted on a base is driven by a card which moves reciprocatingly in parallel to an axis of an electromagnet block mounted on the base as the electromagnet block is energized and de-energized, wherein the base comprises a guide portion for restricting the card in its position.

Therefore, according to the first aspect of the present invention, the card reciprocatingly moves while it is restricted in position by the guide portion provided in the base. This eliminates the need of assembling the card to the elastic contact member, which process would be involved in the prior art. Therefore, the elastic contact member will never undergo plastic deformation so that there will occur no variations in the performance characteristics.

Also, since a single operation of assembling the card to the guide portion provided in the base is sufficient, the number of assembling operations is reduced so that the work becomes less troublesome than would be when the card is assembled to the elastic contact member of the movable contact terminal. Thus, the productivity is improved.

Further, the card is simply brought into contact with the elastic contact member of the movable contact terminal, free from such skew contact as would occur in the prior art. Thus, the contact less wears so that its service life is prolonged advantageously.

A second characteristic aspect of the present invention is that the guide portion is provided on one side of the base within a range from its central portion toward the contact mechanism. According to the second aspect, since the guide portion is located near the contact mechanism, the card is reduced in deflection so that the performance characteristics are improved.

A third characteristic aspect of the present invention is that the guide portion is provided in a pair in line with each other in the base. According to the third aspect, the card is supported at two points so that the assembly precision is further improved and therefore the performance characteristics are improved.

A fourth characteristic aspect of the present invention is that the guide portion has an insertion hole for restricting the card in its position. According to the fourth aspect, since a single operation of inserting the card into the insertion hole of the guide portion is sufficient, the assembling work becomes easy and the productivity is improved.

A fifth characteristic aspect of the present invention is that a pair of guide projections are projectingly provided in the base, while a guide projecting portion for restricting up and down rattling of the card is formed at a ceiling surface of the casing fittable to the base. According to the fifth aspect, since the guide portion to be provided in the base is not necessarily required to be of a generally U-shaped arch type, the base is easy to mold and the mold is simple to manufacture.

A sixth characteristic aspect of the present invention is that the guide portion provided in the base comprises a pair of elastic claws to which the card can be snap fitted at a press in the thickness direction. According to the sixth aspect, since the card can be assembled to the base with one-touch operation, the productivity is improved advantageously.

To achieve the second object, in a seventh characteristic aspect of the present invention, there is provided an electromagnetic relay which comprises a base having an insulating wall of a generally U-shape in its plan view molded integrally at a generally center of a top surface of the base; an electromagnet block which is formed by winding a coil around an iron core and which is located at the top surface of the base so as to be surrounded by the insulating wall on one end side thereof; a contact mechanism located on one side of the top surface of the base partitioned by the insulating wall from one end side of the electromagnet block; an insulating cover covering an upper opening of the insulating wall; and a card for driving the contact mechanism by reciprocatingly moving axially above the insulating cover as the electromagnet block is energized and de-energized.

According to the seventh aspect of the present invention, the electromagnet block can be assembled from above to the top surface of the base partitioned by the insulating wall. Therefore, the electromagnet block can be positioned relative to the contact mechanism with higher assembly precision than in the prior art, so that no variations will occur in the move extent of the card. Thus, the performance characteristics can be prevented from variations.

Also, since there is no need of molding the cylindrical frame integrally with the base, as in the prior art, the base configuration becomes simpler than the prior art counterpart, so that the molding of the base as well as the manufacture of the mold are facilitated.

Further, since the electromagnet block, like the other components, can be assembled to the base from above, the automatic assembling machines are simpler to arrange. Thus, the automatization of the assembly line is facilitated.

An eighth characteristic aspect of the present invention is that the insulating cover has a generally "L"-shaped cross section, and covers at its vertical portion at least a central outer side face of the insulating wall so as to partition the electromagnet block and the contact mechanism from each other in a double structure. According to the eighth aspect of the present invention, since the electromagnet block and the contact mechanism are partitioned in a double structure, the creepage distance between them is prolonged so that the insulating characteristic is further improved.

A ninth characteristic aspect of the present invention is that a pair of projecting portions for sandwiching end portion side faces of the core that are exposed from the electromagnet block are provided at a bottom surface of the insulating cover. According to the ninth aspect of the present invention, since a pair of projecting portions provided in the insulating cover sandwich the end portion side faces of the core to restrict the position of the electromagnet block, the electromagnet block can be prevented from rattling in the widthwise direction so that the assembly precision is improved.

A tenth characteristic aspect of the present invention is that at least one projecting portion for ensuring the reciprocating movement of the card is provided in the top surface of the insulating cover so as to be in contact with the ceiling surface of the casing. According to the tenth aspect, the projecting portion provided at the top surface of the insulating cover contacts and supports the ceiling surface of the casing. Therefore, even if the casing is loaded with external force, the projecting portion receives this external force, preventing the ceiling surface of the casing from making contact with the card. Thus, the reciprocating movement of the card is ensured.

An eleventh characteristic aspect of the present invention is that the electromagnet block is positioned by pressing it to the base with the insulating cover having at its top surface a projecting portion which comes into press contact with the ceiling surface of the casing fitted to the base. According to the eleventh aspect, the electromagnet block is positioned by pressing it with the insulating cover having at its top surface the projecting portion that comes in press contact with the ceiling surface of the casing fitted to the base. Therefore, the electromagnet block is restricted in position in the vertical direction, so that the electromagnet block is prevented from rattling in the vertical direction. Thus, high precision assembly can be attained.

A twelfth characteristic aspect of the present invention is that at least one guide projection for guiding the reciprocating movement of the card is provided at the top surface of the insulating cover. According to the twelfth aspect, the card is restricted in position by making contact with the guide projection provided at the top surface of the insulating cover. Thus, the performance characteristics are free from variations, so that the card will never fall out from the insulating cover.

A thirteenth characteristic aspect of the present invention is that a projecting portion for restricting the card in its position by making contact with the card that has returned to its original position is provided at the top surface of the insulating cover. According to the thirteenth aspect, the card is stopped at a specified position when it returns. There the card keeps a stable extent of movement so that the movable contact is prevented from varying in the move extent. As a result, uniform performance characteristics are obtained, advantageously.

To achieve the third object, according to a fourteenth characteristic aspect of the present invention, there is provided an electromagnetic relay comprising a contact mechanism composed of a fixed contact terminal erectly provided on a base, and a movable contact terminal formed of an elastic contact member which has a movable contact that contacts and separates from a fixed contact of the fixed contact terminal, and which is erectly provided on the base, the movable contact being made to contact and separate from the fixed contact by rocking the elastic contact member in its thickness direction, wherein the fixed contact is located above a top surface of the base, while, out of the elastic contact member of the movable contact terminal formed by arranging a generally U-shaped electrically conductive thin plate spring material into an arch configuration, at least an upper end edge portion of an elastic upper side portion continuous to an elastic base portion supported by the base is bent horizontally, and wherein the movable contact is provided at a lower end portion of an elastic vertical portion continuous to the elastic upper side portion.

According to the fourteenth aspect, the movable contact and the fixed contact can be located near the top surface of the base. Therefore, even if the movable contact terminal and the fixed contact terminal are inclined due to thermal deformation of the base, the fixed contact and the movable contact are less deflected, so that variations in the performance characteristics due to shifts of the fixed contact and the movable contact relative to each other can be prevented.

Also, since the elastic contact member has a longer effective length than the prior art counterpart, the. exposed area is increased so that a movable contact terminal good at heat radiation can be obtained.

Further, since the elastic contact member has a long effective length so that a desired spring constant can be easily obtained, the elastic contact member can be increased in thickness. Therefore, the elastic contact member is prevented from deformation during the process of caulking or other work, whereby the workability is improved.

In particular, since at least the upper end edge portion of the elastic upper side portion is bent horizontally, the elastic upper side portion is formed into a generally "L"-shape in cross section. Therefore, the elastic upper side portion has large rigidity, so that the elastic vertical portion is less distorted. Thus, the elastic vertical portion can be rocked at accurate angles in the thickness direction.

Furthermore, there can be provided an electromagnetic relay in which the elastic vertical portion is free from any complex stress and the contacts can be opened and closed by driving the elastic contact member with a relatively small pressing force.

A fifteenth characteristic aspect of the present invention is that the whole elastic upper side portion of the elastic contact member is bent horizontally. According to the fifteenth aspect, the elastic upper side portion will never be formed into a generally "L"-shape in cross section, so that the elastic vertical portion can be rocked on its base portion. Therefore, even with height restrictions, the elastic vertical portion is long in the effective length and easy to deform. As a result, there can be provided an electromagnetic relay in which the contacts can be opened and closed by driving the elastic contact member with a relatively small pressing force, advantageously.

BRIEF DESCRIPTION OF THE DRAWINGS

FIGS. 5A, 5B, and 5C are main-part enlarged views showing the state prior to operation, during operation, and after operation of the contact mechanism, respectively;

FIGS. 18A, 18B, 18C, and 18D are a plan view, a left side view, a front view, and a right side view, respectively;

FIGS. 19A, 19B, 19C, and 19D are a plan view, a left side view, a front view, and a right side view, respectively;

BEST MODE FOR CARRYING OUT THE INVENTION

Embodiments according to the present invention will now be described with reference to the accompanying drawings of FIGS. 1 through 24.

Figure 1:
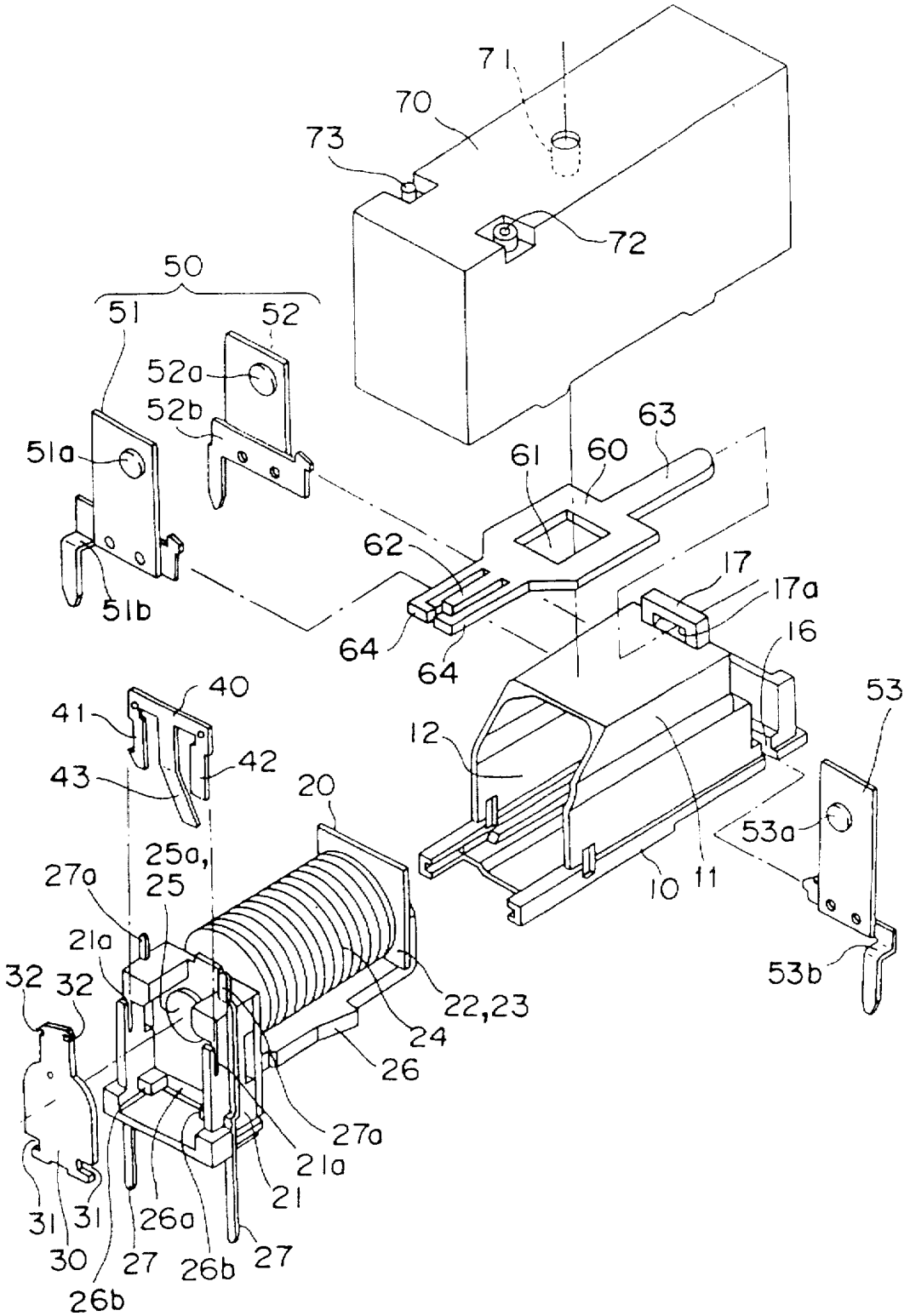
FIG. 1 is an exploded perspective view of an electromagnetic relay according to a first embodiment.
Figure 2:
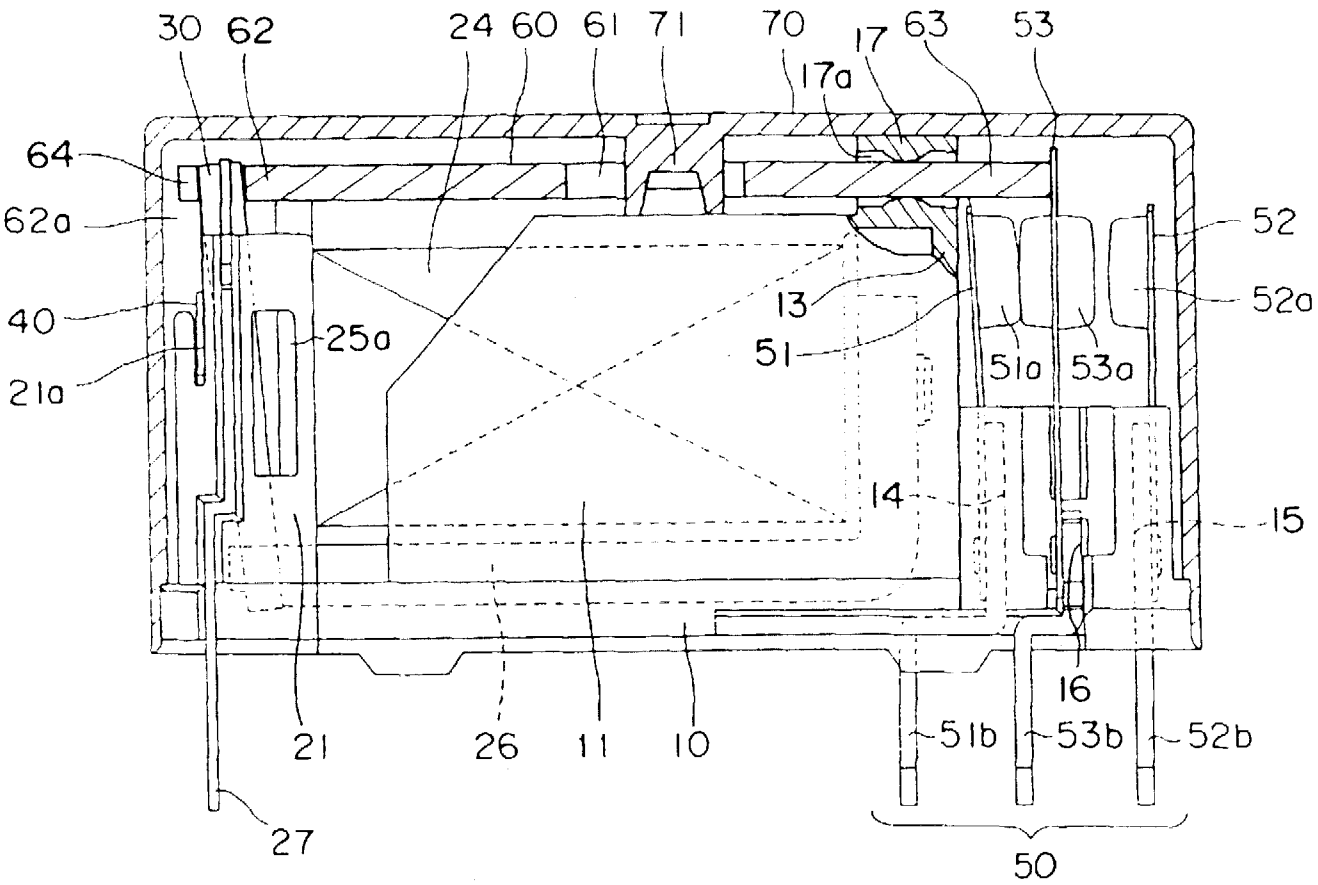
FIG. 2 is a sectional view of the electromagnetic relay according to the first embodiment.
Figure 3:
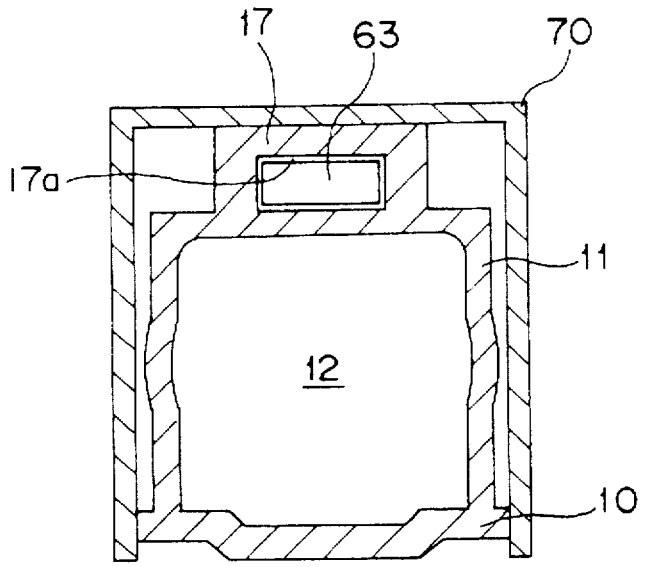
FIG. 3 is a sectional view of a main part of FIG. 2.

The electromagnetic relay according to the first embodiment, as shown in FIGS. 1 to 3, generally comprises a base 10, an electromagnet block 20 to which a moving core 30 is assembled via a hinge spring 40, a contact mechanism 50, a slide type card 60, and a casing 70.

The base 10 has a frame 11 of a generally U-shape in cross section integrally molded at a central portion of its top surface, so as to form a cavity 12. A deeper opening of the cavity 12 is sealed by an insulating wall 13 of the frame 11 as shown in FIG. 2. The base 10 also has press-fit grooves 14, 15, 16 for assembling a later-described movable contact member 53 or the like sideways to places outward of the insulating wall 13 to thereby form the contact mechanism 50, in such a way that the press-fit grooves 14, 15, 16 are alternately staggered. Further, at an edge portion near the contact mechanism 50, out of the top surface of the frame 11, a generally U-shaped guide portion 17 for guiding a later-described card 60 is projectingly provided.

The electromagnet block 20 is formed by winding a coil 24 around a barrel of a spool 23 (not shown) having flanges 21, 22 at both ends, inserting a core 25 of a generally T-shape in cross section into a through hole (not shown) provided in the barrel, and taking one end portion exposed in the front face of the flange 21 as a magnetic-pole portion **25*a* while fixedly caulking the other end portion projected from the flange 22 to a vertical portion of a yoke 26** bent in a generally L-shape in cross section.

The yoke 26 has positioning projecting portions **26*b*, 26*b* projected from both-side upper corners of its horizontal-portion end face 26*a*, and the positioning projecting portions 26*b*, 26*b* are projected from the front face of the flange 21**.

The flange 21 of the spool 23 has, at both-side edge portions of its front face, slits **21*a*, 21*a* for engaging a later-described hinge spring 40. Further, the flange 21 of the spool 23 has coil terminals 27, 27 press-fitted and fixed sideways into its opposite side end faces, and leads are bound up and soldered to binder portions 27*a* located at upper ends of the coil terminals 27**.

The moving core 30 has such a front shape that it can be assembled to a central portion of the front face of the flange 21. Positioning-use cutouts 31, 31 engageable with the positioning projecting portions **26*b*, 26*b* of the yoke 26 are provided at both-side edge portions near the lower end of the moving core 30, while cutouts 32 engageable with the later-described card 60 are provided at both-side edge portions near the upper end of the moving core 30**.

When the cutouts 31, 31 of the moving core 30 are engaged with the positioning projecting portions **26*b*, 26*b* of the yoke 26, respectively, the moving core 30 is opposed to the magnetic-pole portion 25*a* of the core 25 so that it can contact and separate from the magnetic-pole portion 25*a***.

The hinge spring 40 is formed of a thin plate spring material having a generally E-shape in its front view. When arms 41, 42 on both sides of the hinge spring 40 are press-fitted and fixed into the slits **21*a*, 21*a* of the spool 23, a long tongue 43 extending from a central portion of the hinge spring 40 presses a rear-face lower end portion of the moving core 30 so that the moving core 30 is hinged so as to be rockable on the horizontal-portion end face 26*a* of the yoke 26** as a fulcrum.

Then, the electromagnet block 20 to which the moving core 30 is assembled via the hinge spring 40 is inserted into the cavity 12 of the base 10 sideways, whereby they are integrally assembled.

According to the present embodiment, the hinge spring 40 is located below the rear face of the moving core 30, whereby the dead space generated on the rear side of the moving core 30 can be effectively utilized. This advantageously allows the downsizing of the relay unit.

The contact mechanism 50 comprises a pair of fixed contact terminals 51, 52 and a movable contact terminal 53. Fixed contacts **51*a*, 52*a* of the fixed contact terminals 51, 52 and a movable contact 53*a* of the movable contact terminal 53 are located at positions decentered from widthwise center lines of the individual contact terminals by specified distances, respectively. Thus, the contacts 51*a*, 52*a*, 53*a*** are subject to not only bending moment but also torsional moment, so that they are good at anti-deposition characteristic.

Still, since the contacts are located at positions decentered from the widthwise center lines in the individual base portions where the fixed contact terminals 51, 52 and the movable contact terminal 53 are attached, the contact terminals have substantially longer effective spring lengths than when the contacts are located on the center lines. Thus, the electromagnetic relay advantageously can be reduced in height to its corresponding extent.

In addition, the fixed contact terminals 51, 52 and the movable contact terminal 53 are not limited to straight types, but may instead be those having bent shapes in view of material handling.

Terminal portions **51*b*, 52*b* of the fixed contact terminals 51, 52 and a terminal portion 53*b* of the movable contact terminal 53 are press-fitted sideways into the press-fit grooves 14, 15, 16 provided in the base 10 (FIG. 2), respectively, whereby the fixed contacts 51*a*, 52*a* are opposed to each other with the movable contact 53*a*** interposed therebetween.

According to the present embodiment, since the fixed contact terminals 51, 52 and the movable contact terminal 53 are press-fitted sideways and thereby fixed to the press-fit grooves 14, 15, 16 of the base 10, creepage distances between the terminal portions are longer than those of the prior art. Moreover, arch type terminal portions as would be involved in the prior art are not necessitated, and the contact members can be increased in width. Thus, even if a large current is passed therethrough, the contact members are kept low in heat-generating temperature and large in spring force, advantageously.

The slide type card 60, as shown in FIGS. 1 and 2, is formed of a synthetic resin plate material with a generally rectangular shape in its plan view, and has a rectangular fitting hole 61 at its central portion. The slide type card 60 has a drive-use projecting portion 62 projectingly provided at a center of one end face, a pair of elastic engagement legs 64, 64 projected on both sides of the drive-use projecting portion 62, and a long tongue 63 projected from a center of the other end face coaxially with the drive-use projecting portion 62.

Then, the long tongue 63 of the slide type card 60 is inserted into an insertion hole 17*a* of the guide portion 17 of the base 10, while the moving core 30 is positioned between the pair of elastic engagement legs 64, 64 and, as such, pushed in to be engaged therewith. Thus, the card 60 is supported so as to be slidable.

The casing 70 has such a box shape as to be fittable to the base 10, and has an annular projecting portion 71 projected inward from a center portion of its ceiling surface. Further, the casing 70 has a gas bleeder hole 72 at an edge portion of its top surface and a projection 73 that may be bent off to form a gas bleeder hole for bleeding out nitric acid gas and the like generated during use.

When the casing 70 is fitted to the base 10, to which internal components such as the electromagnet block 20 have been assembled, the lower end portion of the projecting portion 71 makes contact with the top surface of the frame 11 of the base 10 via the fitting hole 61 of the card 60 (FIG. 2). Then, a sealing agent (not shown) is injected to the bottom surface of the base 10 and solidified so as to seal it. After inside gas is bled through the gas bleeder hole 72, the gas bleeder hole 72 is thermally fused and thereby sealed. Thus, the assembly work is completed.

According to the present embodiment, since the ceiling surface of the casing 70 is restricted in position via the projecting portion 71, the ceiling surface of the casing 70 will not deflect even if external force is applied to the top surface of the casing 70. Thus, the card 60 is not hindered from operating.

Also, if the gate of the mold is located coaxially with the projecting portion 71, the flow of molding resin is facilitated, whereby the moldability is improved advantageously.

In addition, the projecting portion 71 provided in the casing 70 is not limited to one which is brought into contact with the top surface of the frame 11 provided in the base 10. Alternatively, for example, the projecting portion 71 may be brought into contact with the spool 23 of the electromagnet block 20. Otherwise, the projecting portion 71 may be provided at the top surface of the frame 11 and brought into contact with the ceiling surface of the casing 70. Further, the card 60 may have not a fitting hole but a cutout provided therein.

Next described is the operation of the electromagnetic relay having the above-described construction.

With the electromagnet block 20 unexcited, the movable contact terminal 53 is biased leftward in FIG. 2 by its own spring force, with the movable contact 53*a* in contact with the fixed contact 51*a*.

When the electromagnet block 20 is excited with a voltage applied to the coil 24, the magnetic-pole portion 25*a* of the core 25 attracts the moving core 30, causing the moving core 30 to rock. Thereby, the upper end portion of the moving core 30 presses the end face of the projecting portion 62 provided in the card 60. Therefore, the slide type card 60, which is guided by the guide portion 17, is slid rightward in FIG. 2, so that the long tongue 63 of the card 60 presses the upper end portion of the movable contact terminal 53. As a result, the movable contact terminal 53 rocks, whereby the movable contact 53*a* is switched from the fixed contact 51*a* to the fixed contact 52*a*.

When the electromagnet block 20 is demagnetized, the movable contact terminal 53 returns to the original position by its own spring force, whereby the slide type card 60 is pressed back so that the moving core 30 rocks in a direction opposite to the foregoing. Thus, the movable contact 53*a* is switched from the fixed contact 52*a* to the fixed contact 51*a*, returning to the original state.

Figure 4:
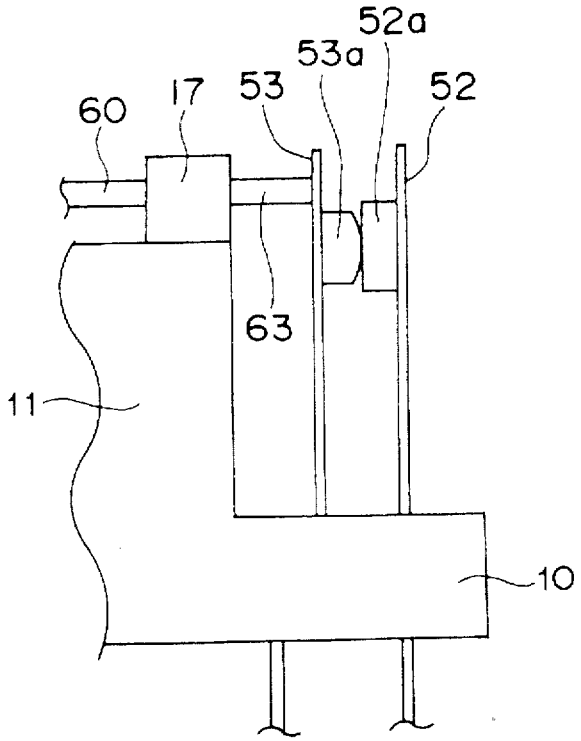
FIG. 4 is a side view of a main part of another application example according to the first embodiment.

The above first embodiment has been described on a case where the fixed contacts 51*a* and 52*a* are opposed to each other with the movable contact 53*a* interposed therebetween. However, the present invention is not necessarily limited to this, but may also be applied to an electromagnetic relay, for example, in which the movable contact 53*a* is put into and out of contact with only the fixed contact 52*a*, as shown in FIG. 4.

Figure 5A:
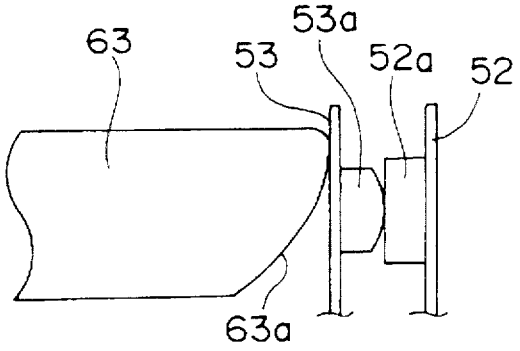
FIGS. 5A through 5C illustrate a contact mechanism of another application example according to the first embodiment, where
Figure 5B:
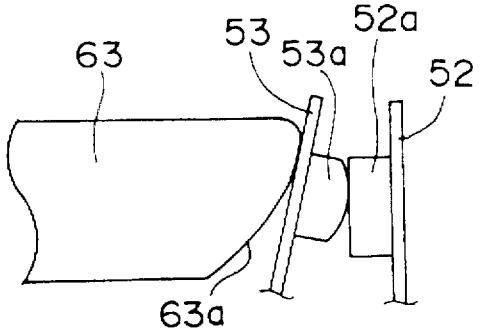
Figure 5C:
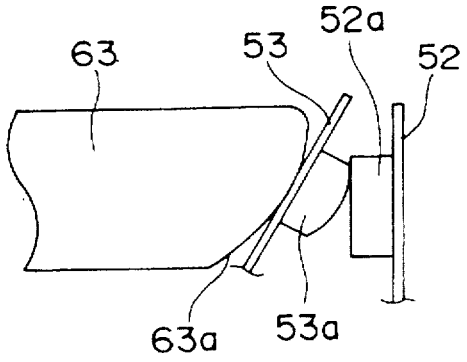

Also, the card 60 may be so arranged not merely that the movable contact 53*a* is pressed against the fixed contact 52*a*, but that, for example as shown in FIGS. 5A to 5C, a rounded surface 63a is formed at an end portion of the long tongue 63 of the card 60.

According to this application example, when the upper end portion of the movable contact terminal 53 is pressed by the long tongue 63 of the card 60 in FIG. 5A, the press point is decentered from the center of the movable contact 53*a*. Therefore, the surface of the movable contact 53*a* is shifted by the press of the long tongue 63 in such a way as to rub against the surface of the fixed contact 52*a* (FIGS. 5B and 5C), whereby the contacts can be effectively prevented from deposition, to an advantage.

Figure 6:
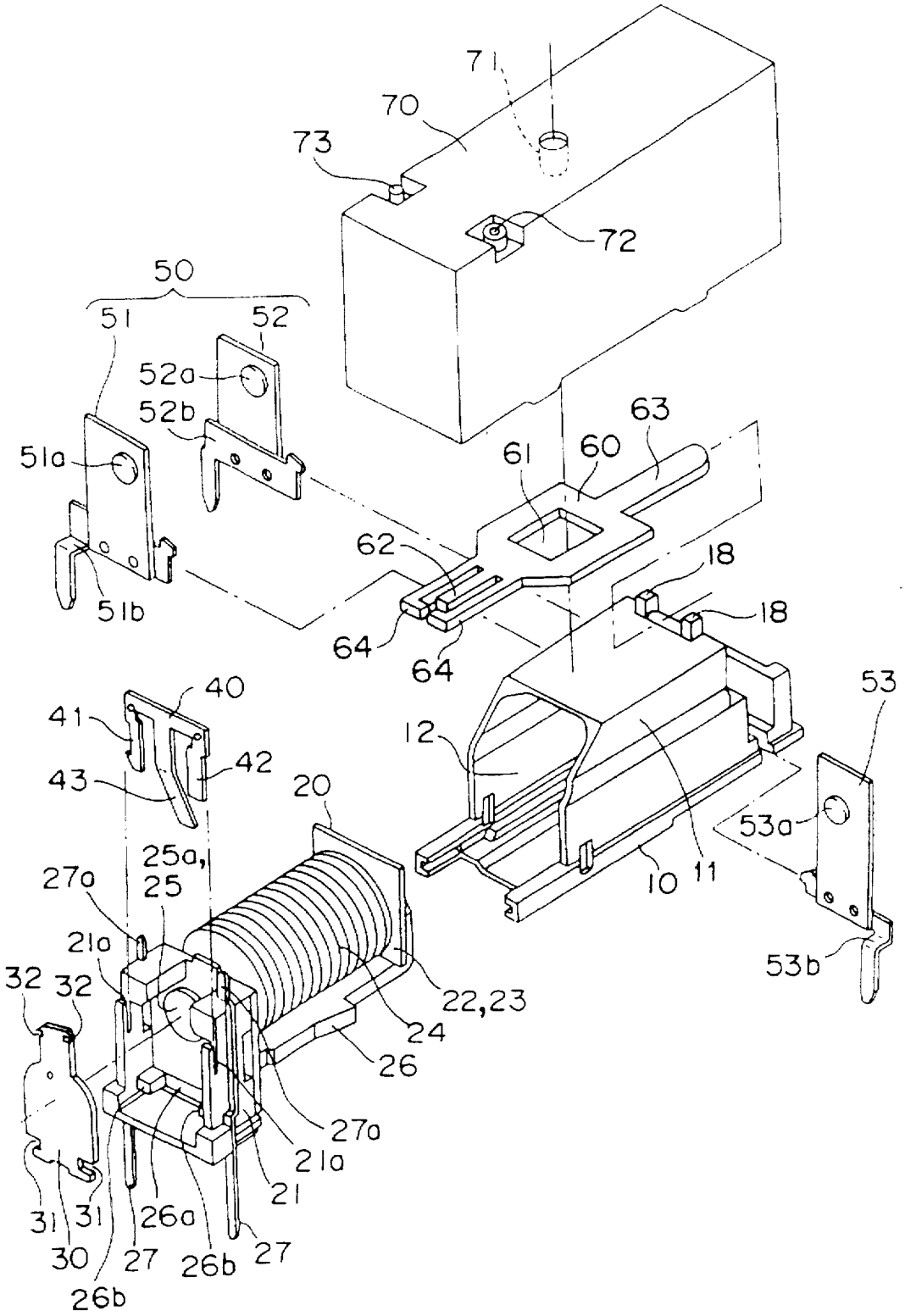
FIG. 6 is an exploded perspective view of an electromagnetic relay according to a second embodiment.

A second embodiment, as shown in FIG. 6, has an arrangement that, whereas the card 60 is restricted in position by the arch type guide portion 17 of a generally U-shape provided in the base 10 in the above-described first embodiment, an insertion hole 18*a* is defined by a pair of guide projections 18, 18 provided in the base 10 and a guide projection portion 74 provided at the ceiling surface of the casing 70 (see FIG. 7), whereby the card 60 is restricted in position.

According to the present embodiment, the molding to the base 10 becomes easier than in the first embodiment, facilitating the manufacture of the mold, advantageously. The rest of the arrangement is similar to that of the above first embodiment and therefore omitted in description.

Figure 8:
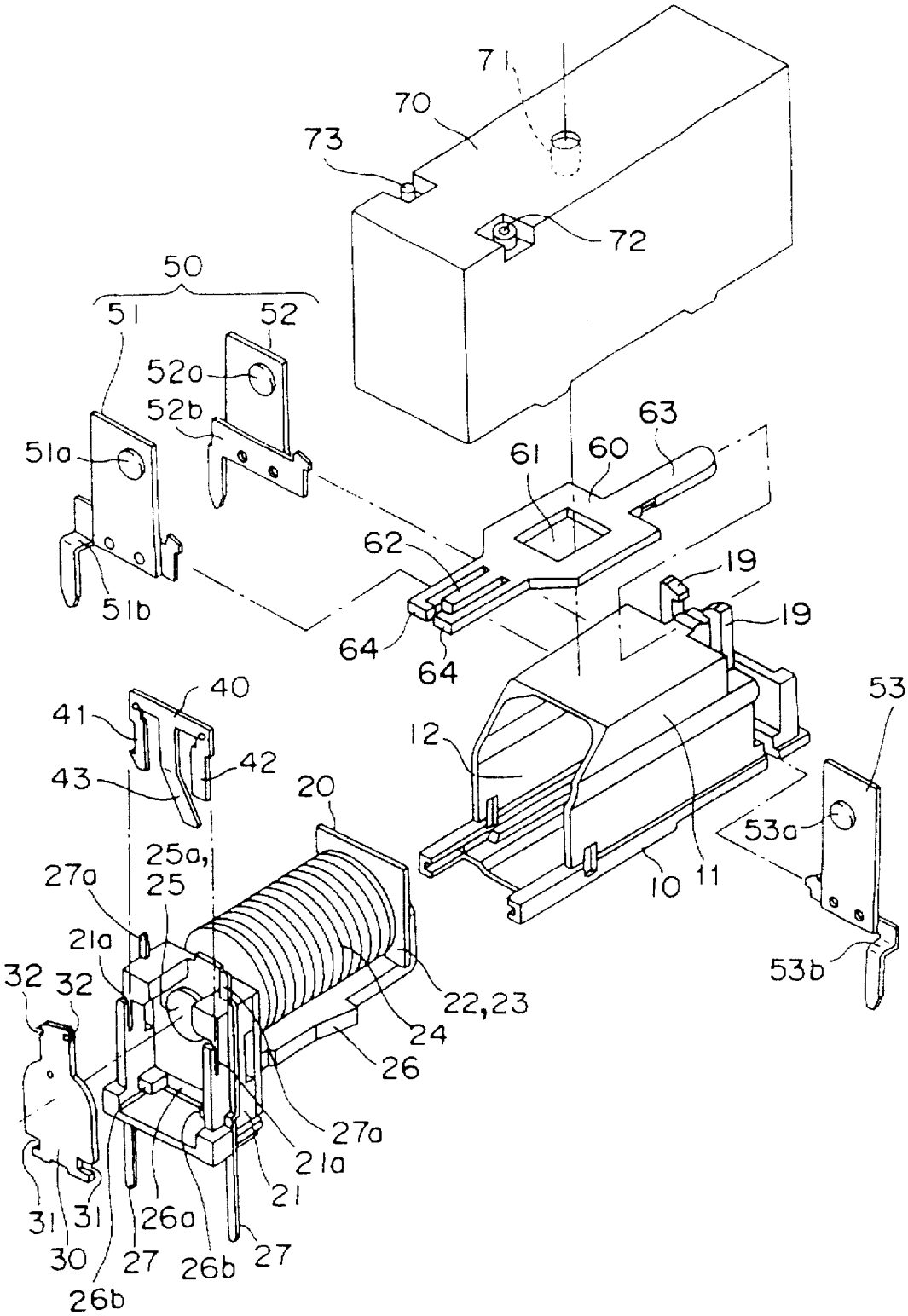
FIG. 8 is an exploded perspective view of an electromagnetic relay according to a third embodiment.

A third embodiment, as shown in FIG. 8, has an arrangement that, whereas the card 60 is restricted in position by inserting the long tongue 63 of the card 60 into the insertion hole 17*a* of the generally U-shaped arch type guide portion 17 provided in the base 10 in the above-described first embodiment, the long tongue 63 of the card 60 is pressed from above to between a pair of elastic claws 19, 19 provided in the base 10, so that the card can be mounted with one-touch operation.

According to the present embodiment, since the card 60 can be assembled to the base 10 from above with one-touch operation, the productivity is improved advantageously. The rest of the arrangement is similar to that of the above-described first embodiment and therefore omitted in description.

Figure 9:
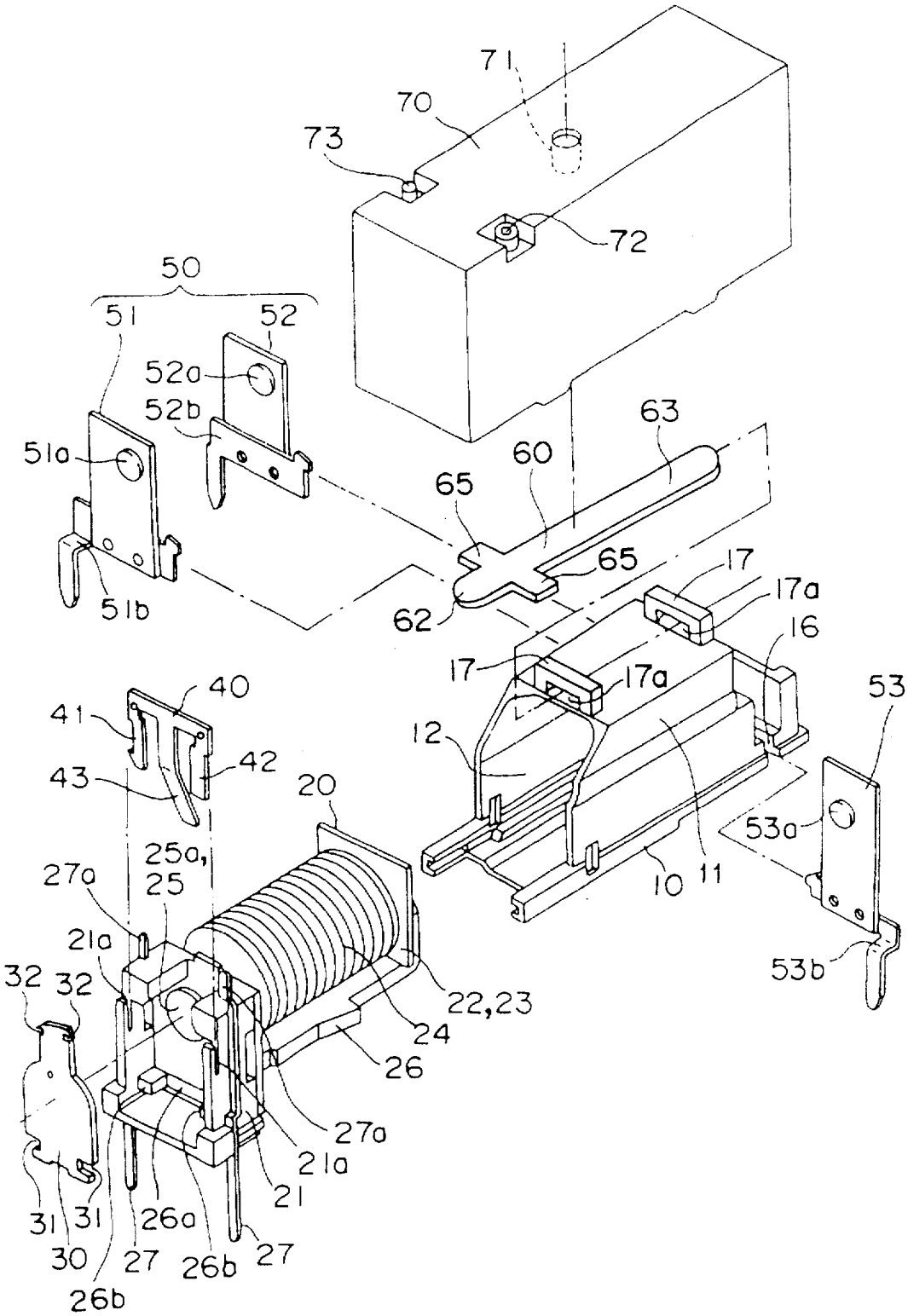
FIG. 9 is an exploded perspective view of an electromagnetic relay according to a fourth embodiment.
Figure 10:
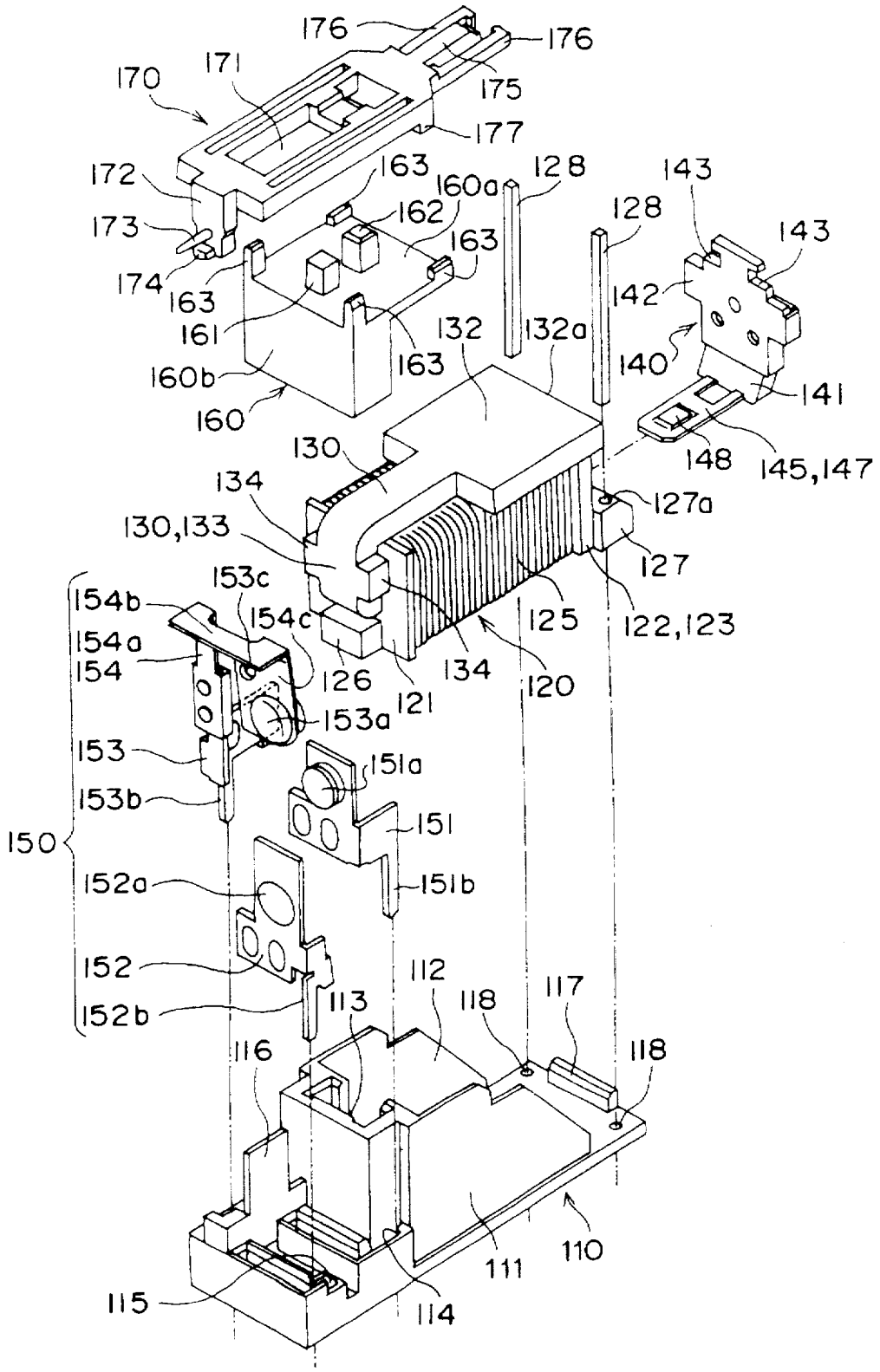
FIG. 10 is an exploded perspective view showing a fifth embodiment of the electromagnetic relay according to the present invention.

A fourth embodiment, as shown in FIG. 9, has an arrangement that, whereas the card 60 is restricted in position by one guide portion in any of the above-described embodiments, the card 60 is restricted in position by a pair of generally U-shaped arch type guide portions 17, 17 projectingly provided in line with each other. Reference numeral 65 denotes an engagement projection of the card 60. The guide portions 17, 17 according to the present embodiment are not limited to the aforementioned shape, but, for example, the shapes of the guide portions of the second and third embodiments are also applicable as a matter of course. The rest of the arrangement is similar to that of the first embodiment and therefore omitted in description.

According to the present embodiment, the card 60 having a cross shape is assembled by inserting the long tongue 63 into the insertion holes 17*a*, 17*a* of the guide portions 17, 17, in which case the card 60 is restricted in position at two points. Thus, the card is further reduced in deflection, so that the performance characteristics are improved advantageously.

An electromagnetic relay according to a fifth embodiment, as shown in FIGS. 10 through 20, generally comprises a base 110, an electromagnet block 120 to which a moving core 140 is assembled via a hinge spring 145, a contact mechanism 150, an insulating cover 160, a card 170, and a casing 180.

The base 110 has a fitting recess 112 defined by integrally molding an insulating wall 111 of a generally U-shape in its plan view in a central portion of its top surface. An engagement groove 113 which communicates with the fitting recess 112 and which can slidingly engage a later-described core 130 of the electromagnet block 120 is provided in the vertical direction at a central portion of the inner surface of the insulating wall 111. Also, in the base 110, terminal holes 114, 115 into which later-described fixed contact terminals 151, 152 can be press-fitted from above are provided at positions located outward of the engagement groove 113 out of the top surface of the base 110, and besides a terminal hole (not shown) which is adjacent to these terminal holes via a partition wall 116 and into which a movable contact terminal 153 can be press-fitted from above is provided. Further, in the base 110, a projecting portion 117 which serves as a transfer guide and which can locate the later-described electromagnet block 120 into position is provided at a top surface end portion opposite to the terminal holes 114, 115, out of the top surface of the base 110. In addition, reference numerals 118, 118 denote terminal holes of a coil terminal 128.

The electromagnet block 120 is formed by winding a coil 125 around a barrel 124 of a spool 123 having flanges 121, 122 at both ends (see FIG. 13), and inserting a single arm 131 of the core 130 bent into a generally U-shape in cross section, into a center hole 124*a* provided in the barrel 124, where a projecting end portion of the single arm 131 is assigned as a magnetic-pole portion 131*a* while an end portion of the remaining single arm 132 is assigned as a magnetic-pole portion 132*a*.

The spool 123 is so constructed that an anti-dropout projecting portion 126 is provided at a lower side edge portion of its flange 121 so as to be projected sideward, while the coil terminal 128 is press-fitted and thereby fixed into a terminal hole 127*a* of a base seat 127 provided at a lower side edge portion of the flange 122 of the spool 123 (where another deeper terminal hole is not shown). At the upper end portion of the coil terminal 128, leads of the coil 125 are bound up and soldered.

It is noted that the anti-dropout projecting portion 126 is designed to prevent the flange 121 of the spool 123 from dropping and hanging at any joint of the belt conveyor while the electromagnet block 120 is conveyed by the belt conveyor in the assembly line, thereby preventing the spool 123 from damage and the coil 125 from disconnection.

Figure 15:
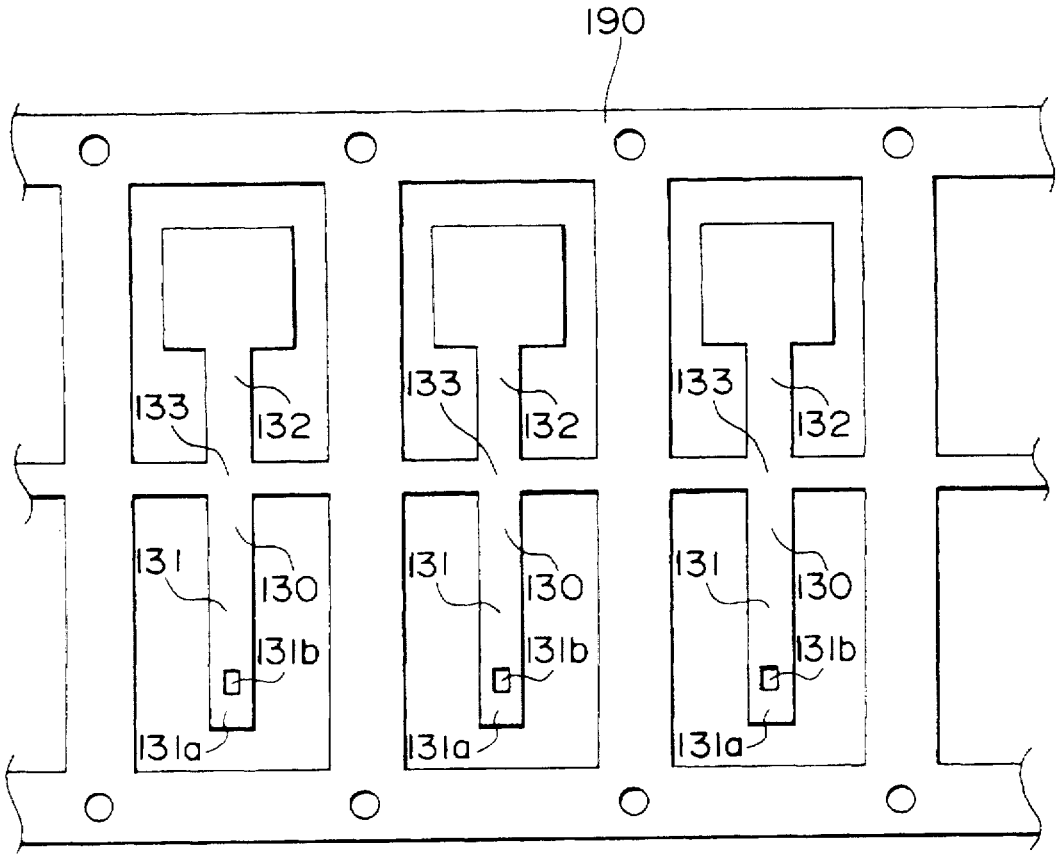
FIG. 15 is a plan view showing a hoop material stamped into a core according to the fifth embodiment of the present invention.
Figure 16:
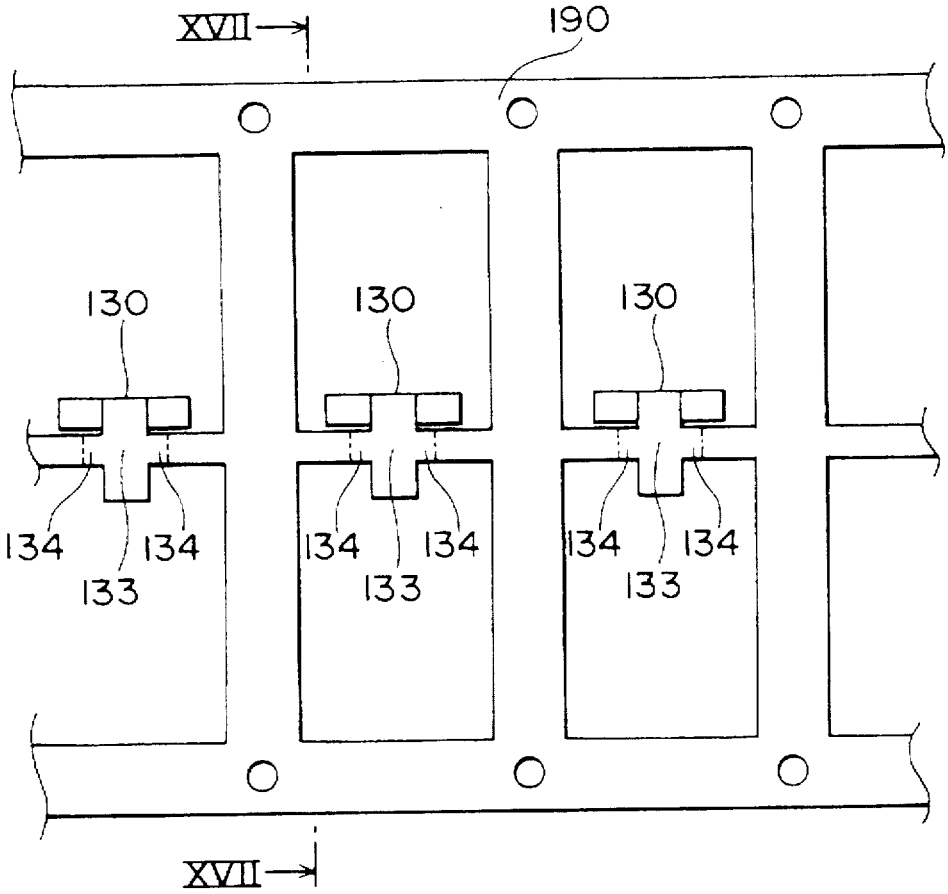
FIG. 16 is a plan view showing the hoop material of FIG. 15 with the core bent.
Figure 17:
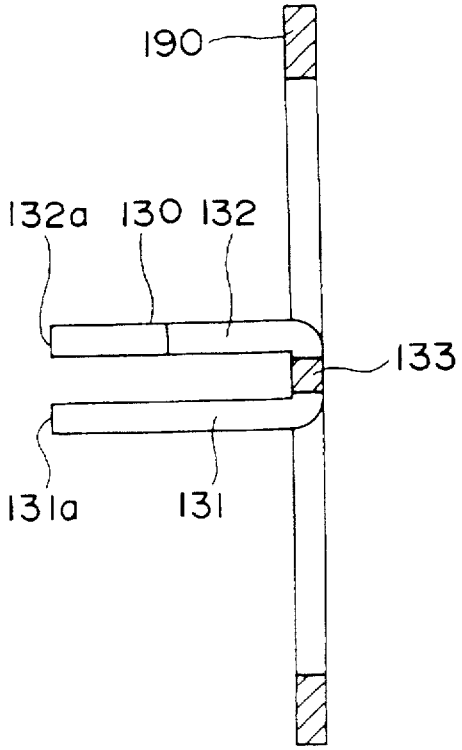
FIG. 17 is a sectional view taken along the line XVII—XVII of FIG. 16.
Figure 18A:
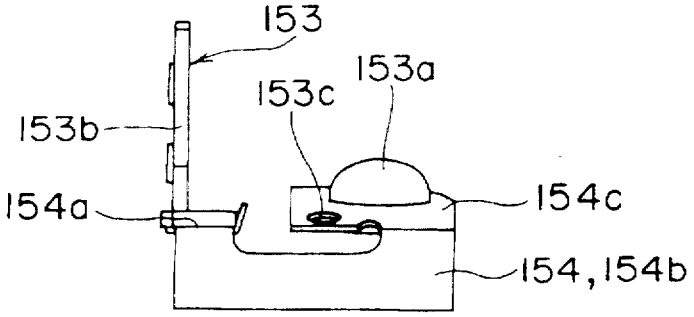
FIGS. 18A through 18D illustrate a fixed contact terminal according to the fifth embodiment of the present invention, where
Figures 18B, 18C, 18D:
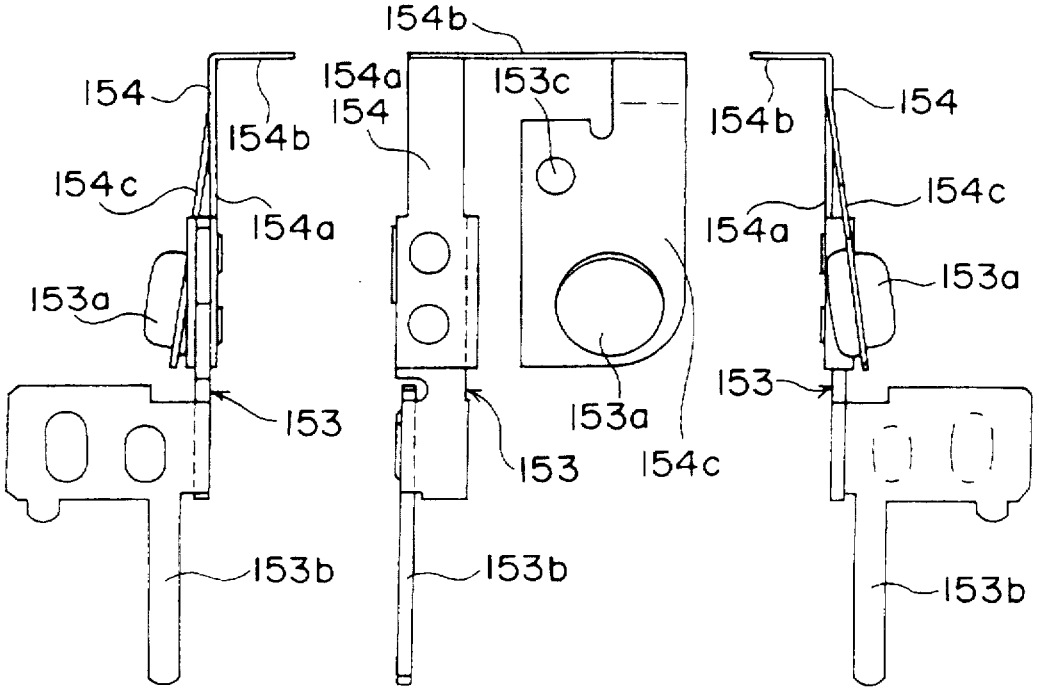
Figure 19A:
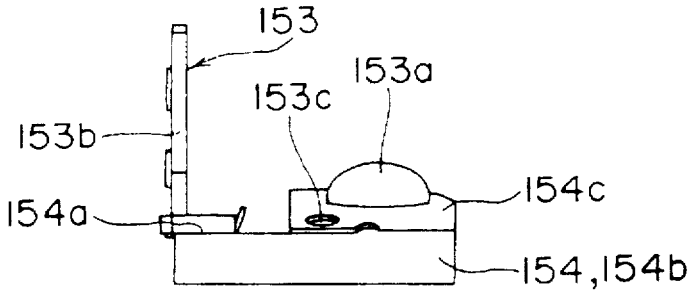
FIGS. 19A through 19D illustrate a modification of the fixed contact terminal according to the present invention, where
Figures 19B, 19C, 19D:
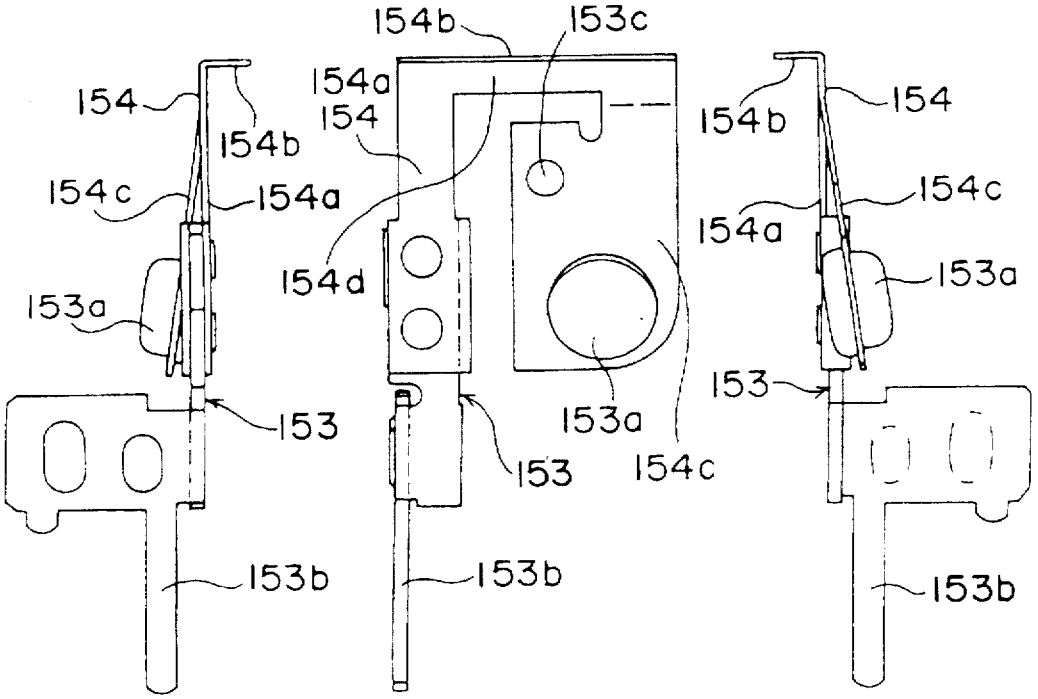

The core 130, as shown in FIGS. 15 to 17, is formed by stamping a hoop material 190 of a thick strip-shaped material, bending it into a generally U-shape in cross section, and then cutting it off, where a pair of ribs 134, 134 for use of positioning are projected from both side faces of the bending portion 133. It is noted that one single arm 132 out of the single arms 131, 132 of the core 130 is large in width at its tip so as to be small in magnetic reluctance. Also, a shallow recess 131*b* for engaging with a later-described hinge spring 145 is provided in proximity to the magnetic-pole portion 131*a* of the single arm 131.

The moving core 140 is formed by stamping a plate-shaped magnetic material, where a taper surface 141 is formed by bending a lower end portion of the magnetic material toward the inner surface side. A portion of the core 130 that is attracted to the wide magnetic-pole portion 132*a* is assigned as a wide portion 142, where a pair of cutouts 143, 143 are provided at both-side end faces upward of the wide portion 142.

Figure 13:
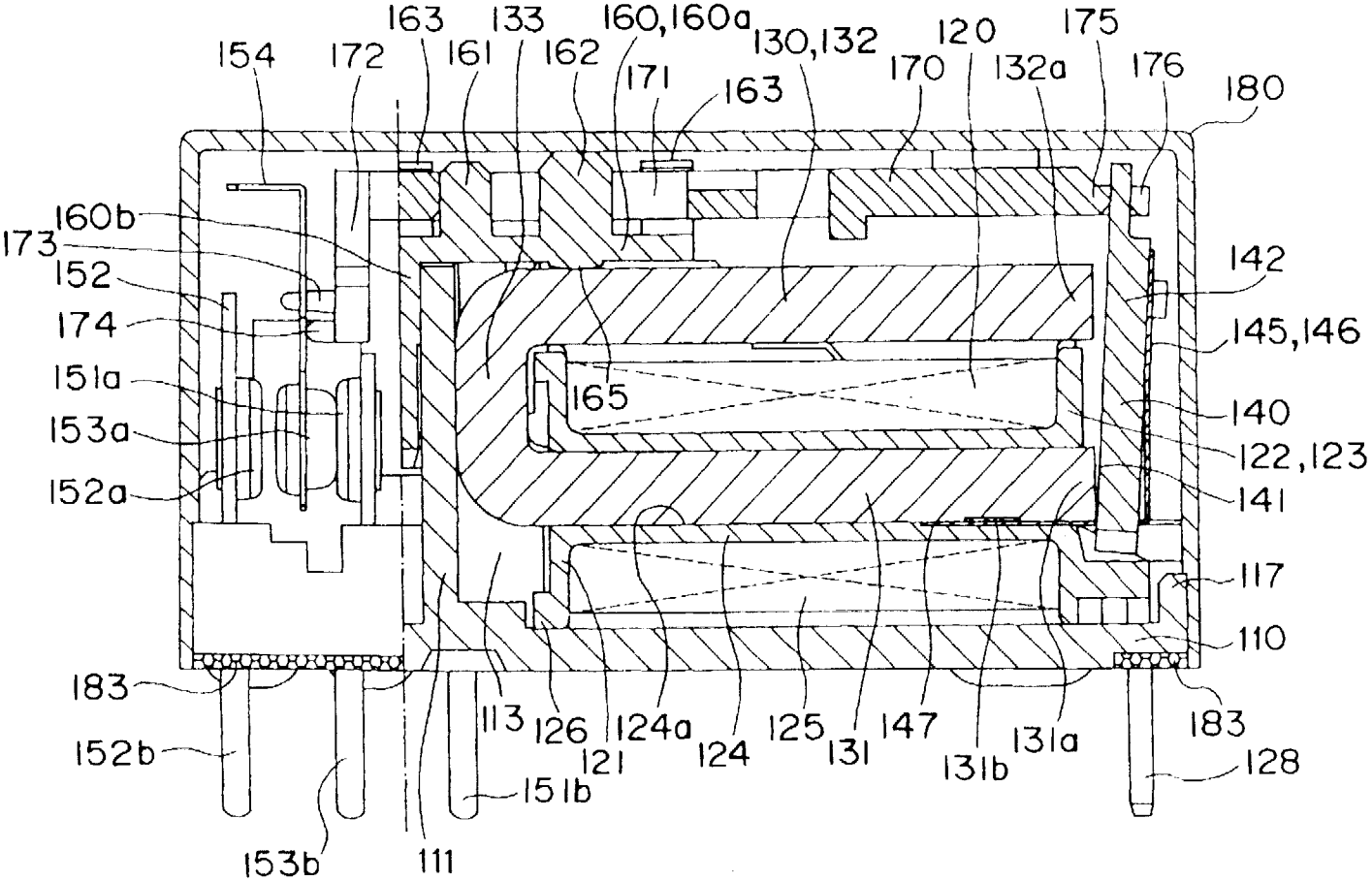
FIG. 13 is a front sectional view of the electromagnetic relay shown in FIG. 10.
Figure 14:
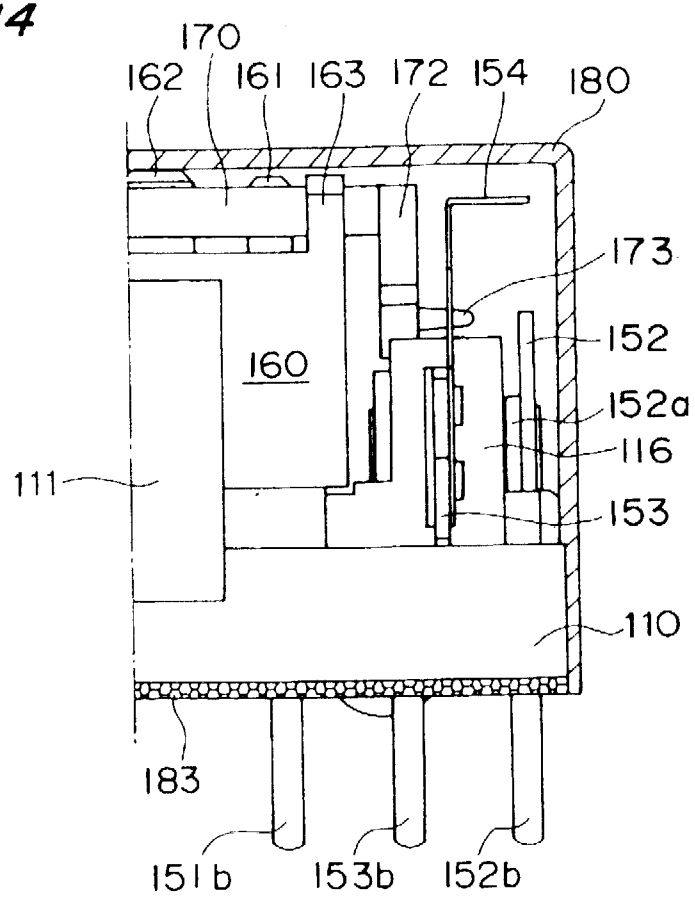
FIG. 14 is a partly rear sectional view of the electromagnetic relay shown in FIG. 10.

The hinge spring 145, as shown in FIG. 13, is made of a thin-plate spring material bent into a generally "L"-shape in cross section, where its vertical portion 146 is fixed to the rear surface of the moving core 140.

Then, a horizontal portion 147 of the hinge spring 145 is press-fitted into a gap between the inner circumferential surface of the center hole 124*a* provided in the spool 123 and the lower surface of the single arm 131 of the core 130, while an elastic claw 148 formed by louvering the horizontal portion 147 of the hinge spring 145 is engaged with the shallow recess 131*b* provided at the lower surface of the single arm 131 so that the elastic claw 148 is prevented from falling out. Thereby, the moving core 140 is supported rockable.

According to the present embodiment, the taper surface 141 of the moving core 140 is normally held in linear contact with the lower edge portion of the end face of the magnetic-pole portion 131*a*. Therefore, even when the moving core 140 rocks, the rocking fulcrum will not move so that stable performance characteristics are obtained. As a result, it is no longer necessary to form a difficult-to-machine taper surface at the end face of the magnetic-pole portion 131*a* of the core 130. Thus, the core 130 becomes easy to manufacture, advantageously.

Subsequently, the electromagnet block 120, to which the moving core 140 is assembled via the hinge spring 145, is fitted from above to the fitting recess 112 of the base 110, while at the same time the projecting portion 126 of the spool 123 and the ribs 134, 134 of the core 130 are fitted to the engagement groove 113 one by one, whereby the electromagnet block 120 is assembled.

According to the present embodiment, the ribs 134, 134 provided at the bending portion 133 of the core 130 are slid and engaged from above with the engagement groove 113 of the spool 123, whereby the electromagnet block 120 can be assembled to the base 110 with high precision, advantageously.

The contact mechanism 150 comprises a pair of fixed contact terminals 151, 152, and a movable contact terminal 153. Fixed contacts 151*a*, 152*a* of the fixed contact terminals 151, 152 are provided at lower positions in proximity to terminal portions 151*b*, 152*b*, respectively.

Meanwhile, the movable contact terminal 153, as shown in FIGS. 18A to 18D, is formed by caulking and fixing a generally arch type elastic contact member 154 separately at the top end of its terminal portion 153*b*. This elastic contact member 154 comprises an elastic base portion 154*a*, an elastic upper side portion 154*b*, and an elastic vertical portion 154*c*. The elastic upper side portion 154*b* is bent horizontally on the whole, while the elastic vertical portion 154*c* has a movable contact 153*a* provided thereon and a through hole 153*c* formed therein.

According to the present embodiment, since the elastic vertical portion 154*c* is rockable on its base portion, the elastic vertical portion 154*c* has a long effective length and will easily deform even when its height is limited. Thus, there can be provided an electromagnetic relay in which the contacts can be opened and closed by driving the elastic vertical portion 154*c* with a relatively small pressing force.

Also, since the elastic contact member 154 is long in its overall effective length, there can be obtained a movable contact terminal 153 which is large in exposed area and superior in heat radiation.

Further, since the elastic contact member 154 is long in its overall effective length so that a desired spring constant can be easily attained, the elastic contact member 154 can be increased in thickness. Therefore, the elastic contact member 154 is prevented from deforming during the caulking or other process, offering an advantage of higher workability.

In addition, the movable contact terminal 153 is not limited to the aforementioned one. Alternatively, for example as shown in FIGS. 19A to 19D, it may be such that the elastic upper side portion 154*b* of the elastic contact member 154 is bent horizontally at only a fore edge portion thereof to form a vertical portion 154*d*, whereby the elastic upper side portion 154*b* is formed into a generally "L"-shape.

According to this arrangement, since the elastic upper side portion 154*b* is large in rigidity, the elastic vertical portion 154*c* is unlikely to distort. Thus, the elastic vertical portion 154*c* can be rocked at correct angles.

Also, the elastic vertical portion 154*c* undergoes no complex stress, so that the contacts can be opened and closed by driving the elastic contact member 154 with a relatively small pressing force, advantageously. The rest of the arrangement is similar to that of the above-described movable contact terminal 153 and therefore omitted in description.

Then, the terminal portions 151*b*, 152*b* of the fixed contact terminals 151, 152 and the terminal portion 153*b* of the movable contact terminal 153 are press-fitted into the terminal holes 114, 115 provided in the base 110 (where the terminal hole of the movable contact terminal 153 is not shown), whereby the movable contact 153*a* is positioned between the fixed contacts 151*a* and 152*a* opposite to each other at a specified interval so that the movable contact 153*a* can be brought into and out of contact therewith.

According to the present embodiment, since the fixed contacts 151*a*, 152*a* and the movable contact 153*a* are disposed in proximity to their corresponding terminal portions 151*b*, 152*b*, and 153*b*, respectively, each at a low position, the fixed contacts 151*a*, 152*a* and the movable contact 153*a* are positioned in proximity to the top surface of the base 110. Therefore, for example, even if the fixed contact terminals 151, 152 and the movable contact terminal 153 are inclined due to thermal deformation of the base 110, the fixed contacts 151*a*, 152*a* and the movable contact 153*a* are less deflected, whereby variations in the. performance characteristics due to shifts among the fixed contacts 151*a*, 152*a* and the movable contact 153*a* can be prevented advantageously.

Figure 20:
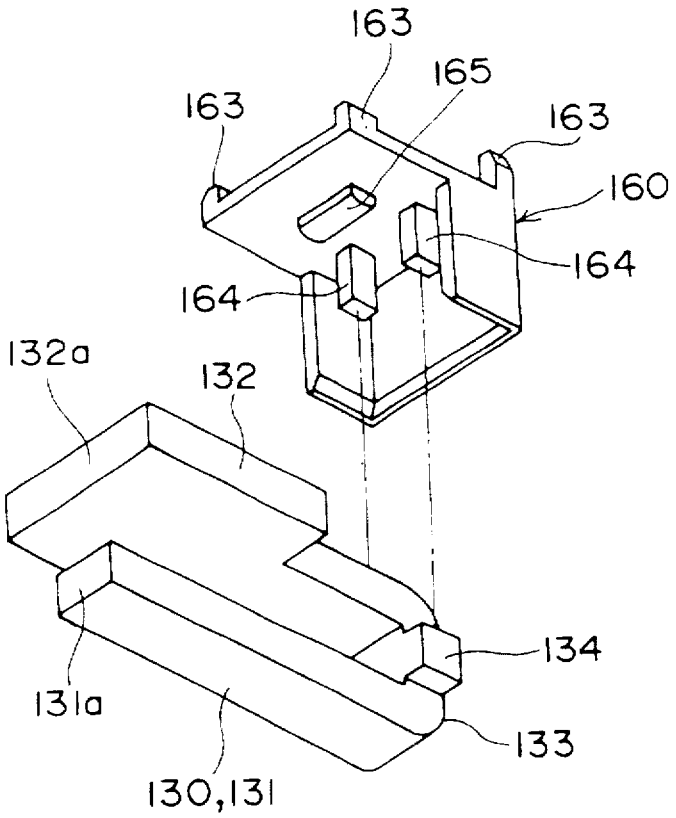
FIG. 20 is an exploded perspective view for explaining the way how the insulating cover is assembled, according to the present invention.

The insulating cover 160 is a resin molded product having a generally "L"-shaped cross section and designed to insulate the contact mechanism 150 from the electromagnet block 120. In the insulating cover 160, a projecting portion 161 for restricting the return position of a later-described card 170 and a projecting portion 162 for ensuring the reciprocating movement of the card 170 are provided at top surface central portions of a horizontal portion 160*a* of the insulating cover 160, while a guide projection 163 for guiding the card 170 and preventing it from falling off is provided at a top surface corner of the horizontal portion 160*a*. Further, as shown in FIG. 20, in the insulating cover 160, a pair of projecting portions 164, 164 for sandwiching the bending portion 133 of the core 130 and a projection 165 which will come into press contact with the upper surface of the single arm 132 of the core 130 are provided at the lower surface of the horizontal portion 160*a* of the insulating cover 160.

When the insulating cover 160 is fitted and fixed to the insulating wall 111 of the base 110, to which the electromagnet block 120 has been assembled, the projecting portions 164, 164 of the insulating cover 160 sandwich the bending portion 133 of the core 130, and moreover push down its ribs 134, 134 for positional restriction, while the projection 165 of the insulating cover 160 is brought into contact with the upper surface of the single arm 132 of the core 130, thereby preventing the electromagnet block 120 from falling off.

According to the present embodiment, a vertical portion 160*b* of the insulating cover 160 overlaps with the insulating wall 111 of the base 110 into a double-wall structure. Thus, the creepage distance between the electromagnet block 120 and the contact mechanism 150 is prolonged, so that the insulating characteristic is further improved advantageously.

The slide type card 170 is a synthetic resin molded product having a generally rectangular shape in its plan view and has a rectangular fitting hole 171 at a central portion thereof. The slide type card 170 has a long tongue 172 extending downward from a central portion of one end face, and a fitting projection 173 and a press projection 174 provided downward of the long tongue 172. Meanwhile, the slide type card 170 has a drive-use projecting portion 175 projectingly provided at a central portion of the other end face, and a pair of elastic engagement legs 176, 176 provided so as to be projected from both sides of the drive-use projecting portion 175.

Further, in the card 170, a linear projection 177 in association with a guide rail is provided at the lower surface of the card 170 along the widthwise direction. The linear projection 177 is designed to prevent the card 170 from falling off when the card 170 is slid along the guide rail (not shown), and thereby to align the card 170 in one direction. However, the linear projection 177 is not limited to this arrangement but may also be provided at the upper surface of the card 170. Otherwise, two projections may be provided in line to substitute therefor.

According to the present embodiment, out of the long tongue 172 and the linear projection 177, at least either one of them is engaged with the edge portion of the guide rail so that the card 170 is automatically aligned in one direction. Thus, the assembly work, particularly the automatization of assembly is further facilitated, advantageously.

Then, the fitting projection 173 of the slide type card 170 is inserted into the through hole 153*c* of the movable contact terminal 153 while the moving core 140 is positioned between the pair of elastic engagement legs 176, 176 and pushed in to be engaged with the cutouts 143, 143. Thereby, the card 170 is supported so as to be reciprocatingly movable.

According to the present embodiment, the long tongue 172 is extended downward from an end face central portion of the card 170, and the fitting projection 173 and the press projection 174 are provided downward of the long tongue 172. Thus, even if any vibration or impact force is applied from external, the long tongue 172 absorbs and relaxes it. Therefore, since the long tongue 172 functions to prevent any malfunction due to vibrations or the like, high reliability is attained.

Also, since the contact mechanism 150 is limited in structure, the degree of freedom for design is large to an advantage.

Figure 11:
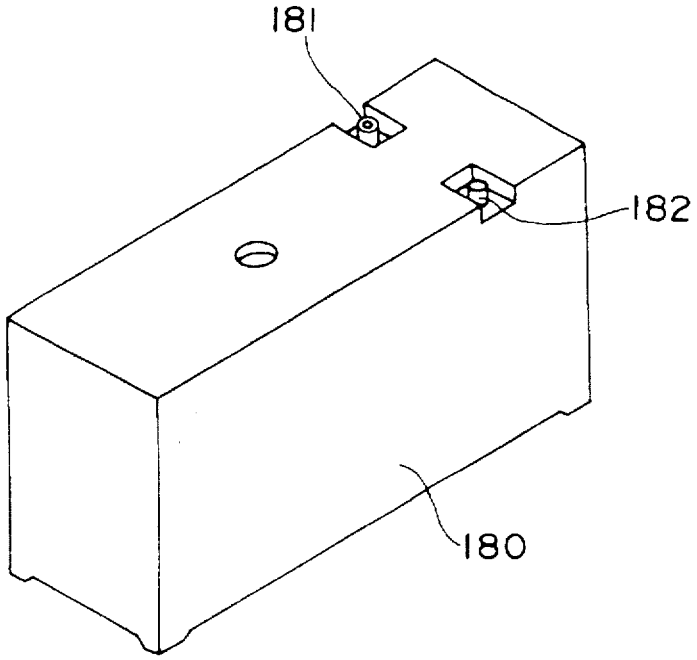
FIG. 11 is a perspective view representing a casing of the electromagnetic relay shown in FIG. 10.
Figure 12:
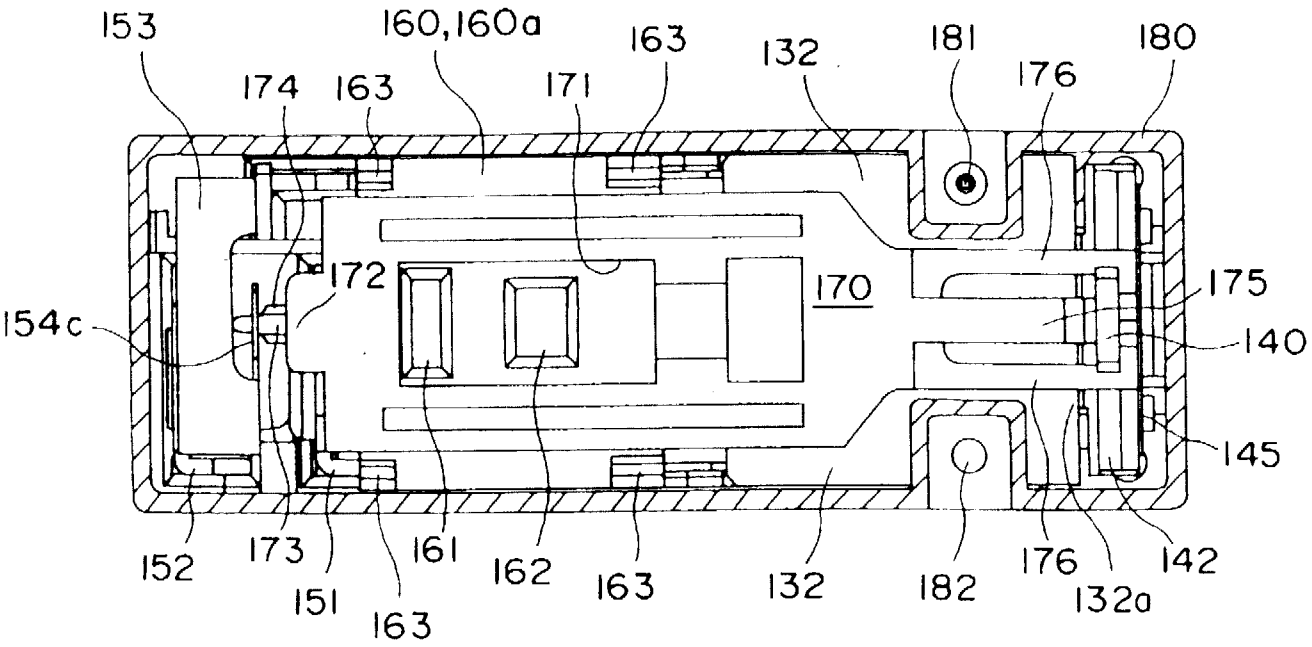
FIG. 12 is a planar sectional view of the electromagnetic relay shown in FIG. 10.

The casing 180, as shown in FIG. 11, has such a box shape as to be fittable to the base 110. In the casing 180, a gas bleeder hole 181 is provided at one-side edge portion of its ceiling surface, while a projection 182 is further provided which allows a gas bleeder hole to be formed by folding and removing it for the purpose of bleeding out nitric acid gas generated during use.

When the casing 180 is fitted to the base 110, to which the internal components such as the electromagnet block 120 have been assembled, as shown in FIG. 13, the ceiling lower surface of the casing 180 is brought into press contact with the projecting portion 162 of the insulating cover 160, so that the projection 165 of the insulating cover 160 presses the single arm 132 of the core 130, thereby restricting the position of the electromagnet block 120. Then, a sealing agent 183 is injected to the bottom surface of the base 110, and solidified to seal it. After inside gas is purged through the gas bleeder hole 181, the gas bleeder hole 181 is thermally fused so as to be sealed. Thus, the assembly work is completed.

According to the present embodiment, since the casing 180 presses the core 130 via the projecting portion 162 and projection 165 of the insulating cover 160, the core 130 can be prevented from coming out. Moreover, even if any external force is loaded to the ceiling surface of the casing 180, the projecting portion 162 and projection 165 of the insulating cover 160 receive the force. Thus, the ceiling surface of the casing 180 is hardly distorted so that the card 170 is not hindered from reciprocating movement, advantageously.

Now the operation of the electromagnetic relay having the above-described construction is described.

If the electromagnet block 120 is unexcited as shown in FIG. 13, the card 170 is urged toward the moving core 140 by the spring force of the elastic contact member 154 of the movable contact terminal 153. Thus, the inner surface of its fitting hole 171 is put into contact with the projecting portion 161 of the insulating cover, whereby the card 170 is restricted in position, while the movable contact 153*a* is put into contact with the fixed contact 151*a*.

When the electromagnet block 120 is excited with a voltage applied to its coil 125, the magnetic-pole portion 132*a* of the core 130 attracts the moving core 140, whereby the moving core 140 rocks on the fulcrum of an endface lower edge portion of the magnetic-pole portion 131*a* of the core 130, such that its wide portion 142 is attracted to the magnetic-pole portion 132*a* of the single arm 132. As a result, the moving core 140 presses the drive-use projecting portion 175 of the card 170 so that the card 170 slidingly moves toward the contact mechanism 150 against the spring force of the elastic contact member 154. Thus, the press projection 174 provided in the long tongue 172 of the card 170 presses the elastic vertical portion 154*c* of the movable contact terminal 153, whereby the movable contact 153*a* is switched from the fixed contact 151*a* to the fixed contact 152*a*.

Subsequently, when the electromagnet block 120 is demagnetized, the card 170 is pushed back by the spring force of the elastic contact member 154, causing the wide portion 142 of the moving core 140 to be separated from the magnetic-pole portion 132*a* of the core 130. As a result, the inner surface of the fitting hole 171 of the card 170 comes into contact with the projecting portion 161 of the insulating cover 160, whereby the card 170 is restored to the original position, while the movable contact 153*a* is switched to the fixed contact 151*a* so as to be restored to the original state.

According to the present embodiment, since the card 170 is restricted in position by one projecting portion 161 and four guide projections 163 provided in the insulating cover 160, the performance characteristics will not vary, nor will the insulating cover 160 fall out.

According to the present embodiment, since the taper surface 141 is formed in the moving core 140 to prevent the rocking fulcrum from moving, there is no need of forming a taper surface at an end face of the magnetic-pole portion 131*a* that is difficult to machine. Thus, the manufacture of the core 130 is facilitated, advantageously.

In addition, in order to prevent the card 170 from falling off, it is unnecessary to provide all of the aforementioned projecting portion 161 and four projections 163, but it is allowed to provide only the projecting portion 161 or to provide the projecting portion 161 and two projections 163.

It may also be arranged that a pair of opposite guide projections are provided at the upper surface of the horizontal portion 160*a* of the insulating cover 160, and that the card 170 is installed between these guide projections so as to be reciprocatingly movable, whereby the contacts are opened and closed.

Further, it may be arranged that a pair of elastic claws as shown in FIG. 8 are projectingly provided at the upper surface of the horizontal portion 160*a* of the insulating cover 160, and the card 170 is installed by pushing it from above to between these elastic claws, whereby the card is restricted in position in the vertical direction as well as in the horizontal direction.

Moreover, it may be arranged that one arch type projecting portion of a generally U-shape in its front view as shown in FIG. 1 is formed at the upper surface of the horizontal portion 160*a* of the insulating cover 160, or that a plurality of arch type projecting portions of a generally U-shape in its front view as shown in FIG. 9 are formed in line at the upper surface of the horizontal portion 160*a* of the insulating cover 160, in which arrangement the card is inserted into the projecting portion whereby it is restricted in position in the vertical direction as well as in the horizontal direction simultaneously.

Figure 7:
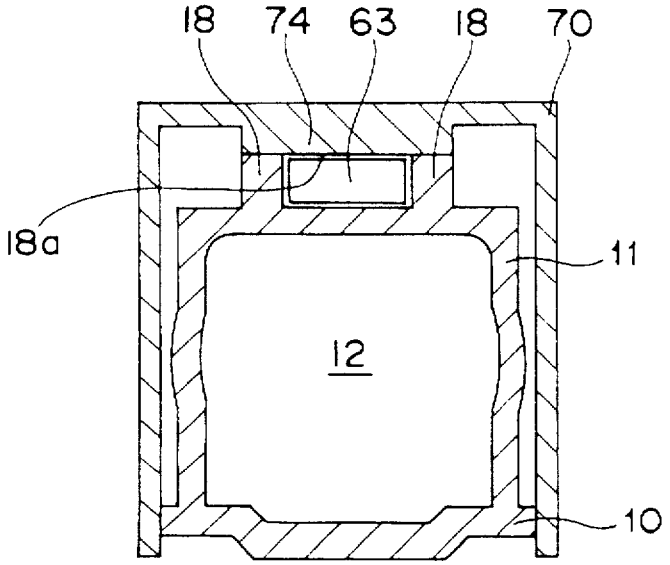
FIG. 7 is a main-part sectional view of the electromagnetic relay according to the second embodiment.

Next, the card 170 may also be restricted in position not limitatively via the projecting portion provided at the upper surface of the horizontal portion 160*a* of the insulating cover 160, but via one or a plurality of projecting portions provided at the ceiling surface of the casing 180 or via one or a plurality of projecting portions or projections provided, for example, at both the ceiling surface of the casing 180 and the upper surface of the horizontal portion 160*a* of the insulating cover 160 as shown in FIGS. 6 and 7.

However, the aforementioned guide projecting portion is preferably located in proximity to the contact mechanism 150 in order that the performance characteristics are kept free from variations by reducing the deflection of the card 170.

Figure 21:
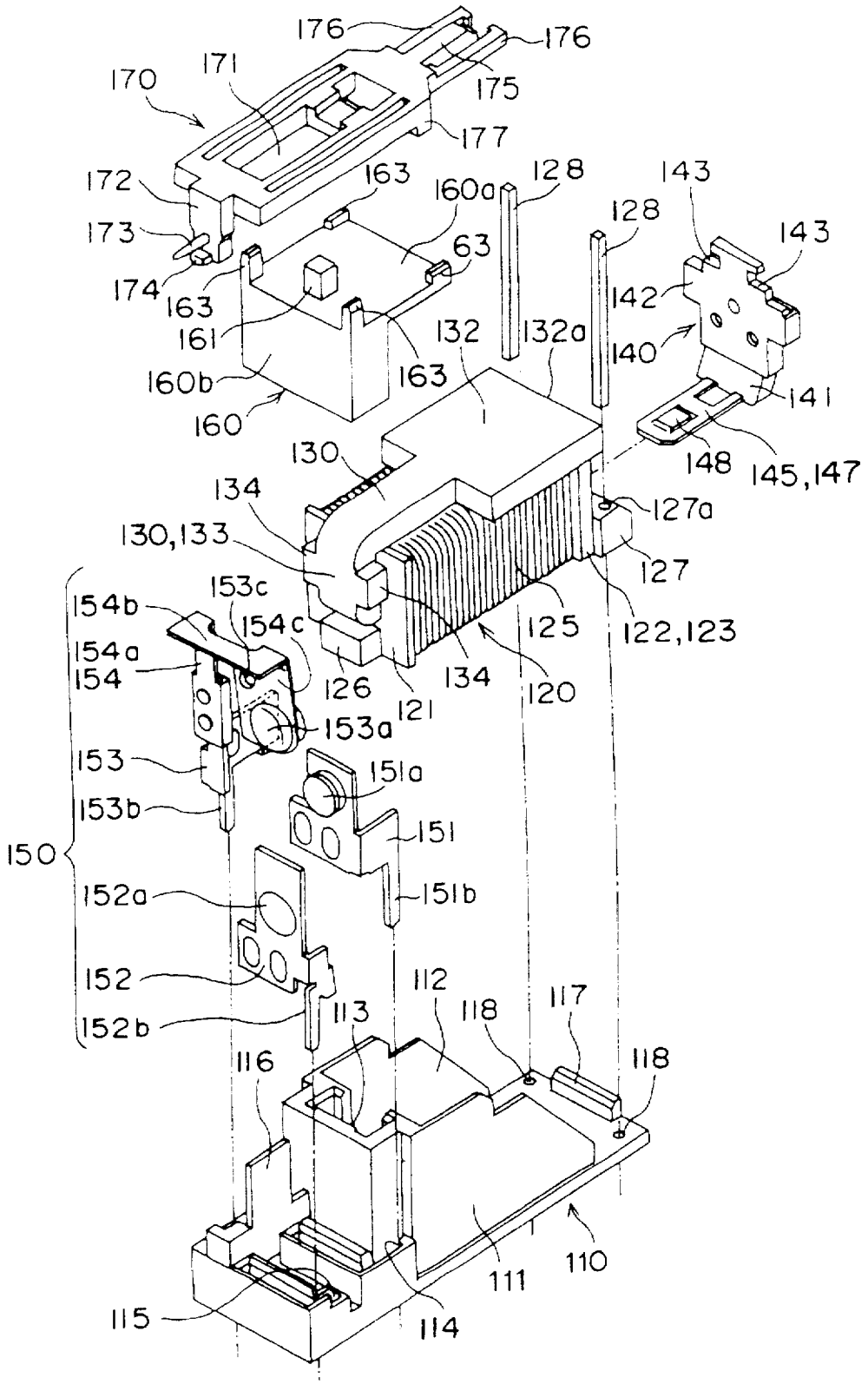
FIG. 21 is an exploded perspective view showing a sixth embodiment of the electromagnetic relay according to the present invention.

The second embodiment, as shown in FIG. 21, has an arrangement that, whereas the reciprocating movement of the card 170 is ensured by the projecting portion 162 provided at the upper surface of the horizontal portion 160*a* of the insulating cover 160 in the aforementioned first embodiment, the reciprocating movement of the card 170 is ensured by the projecting portion 161 that restricts the card 170 in its position at the time of return. The rest of the arrangement is similar to that of the first embodiment and therefore omitted in description.

Figure 22:
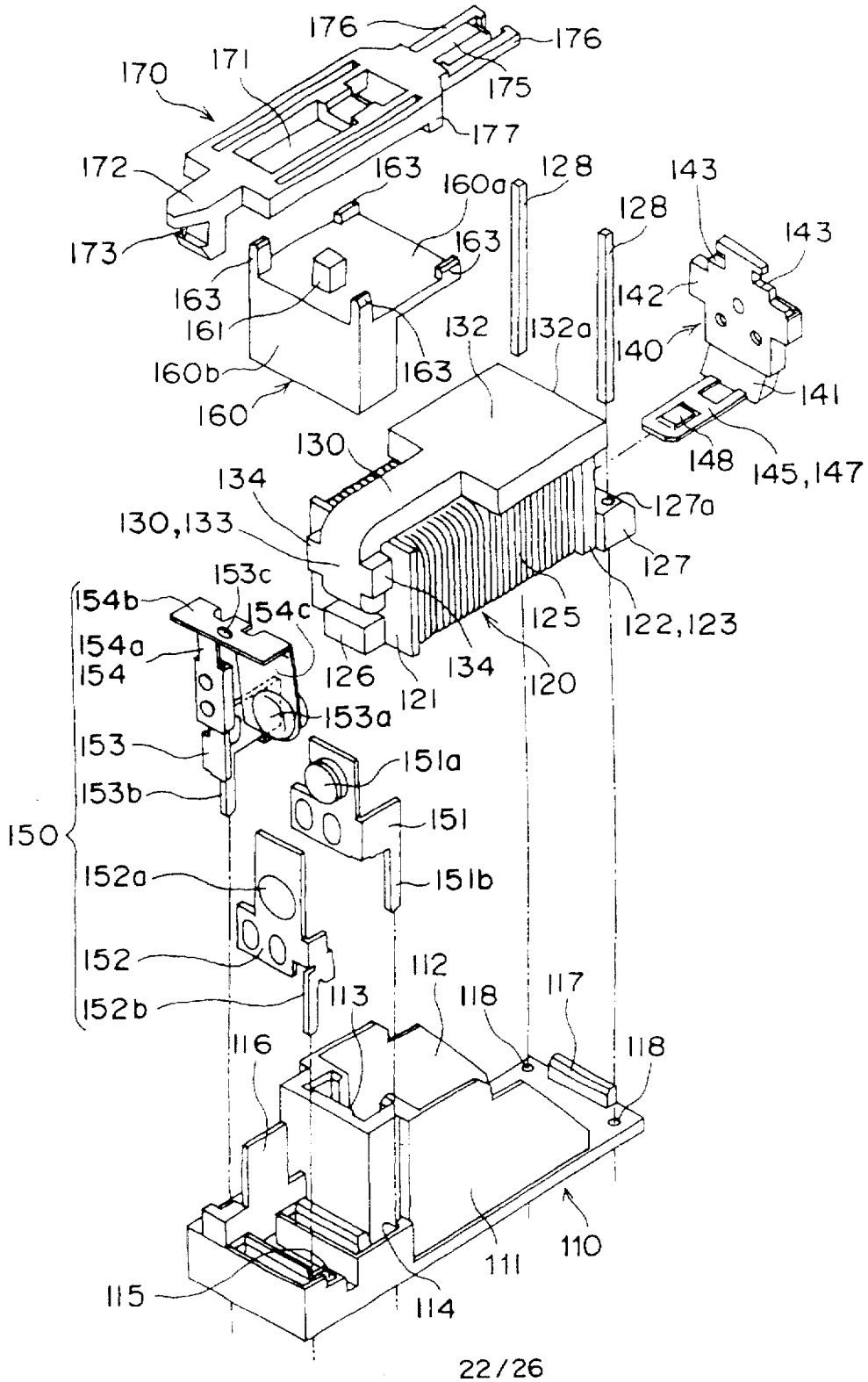
FIG. 22 is an exploded perspective view showing a seventh embodiment of the electromagnetic relay according to the present invention.

The third embodiment, as shown in FIG. 22, is so arranged that the card 170 may be assembled from above in a single direction.

More specifically, the long tongue 172 is extended horizontally from an end face central portion of the card 170, and the fitting projection 173 is projectingly provided at the lower surface of its end portion, while the through hole 153*c* is provided at the elastic upper side portion 154*b* of the movable contact terminal 153.

With this arrangement, when the card 170 is pushed down from above, the fitting projection 173 of the card 170 is fitted to the through hole 153*c* of the movable contact terminal 153 while the elastic engagement legs 176, 176 of the card 170 are fitted to the cutouts 143, 143 of the moving core 140, whereby the card 170 is supported so as to be reciprocatingly movable. The rest of the arrangement is similar to that of the first embodiment and therefore omitted in description.

Figure 23:
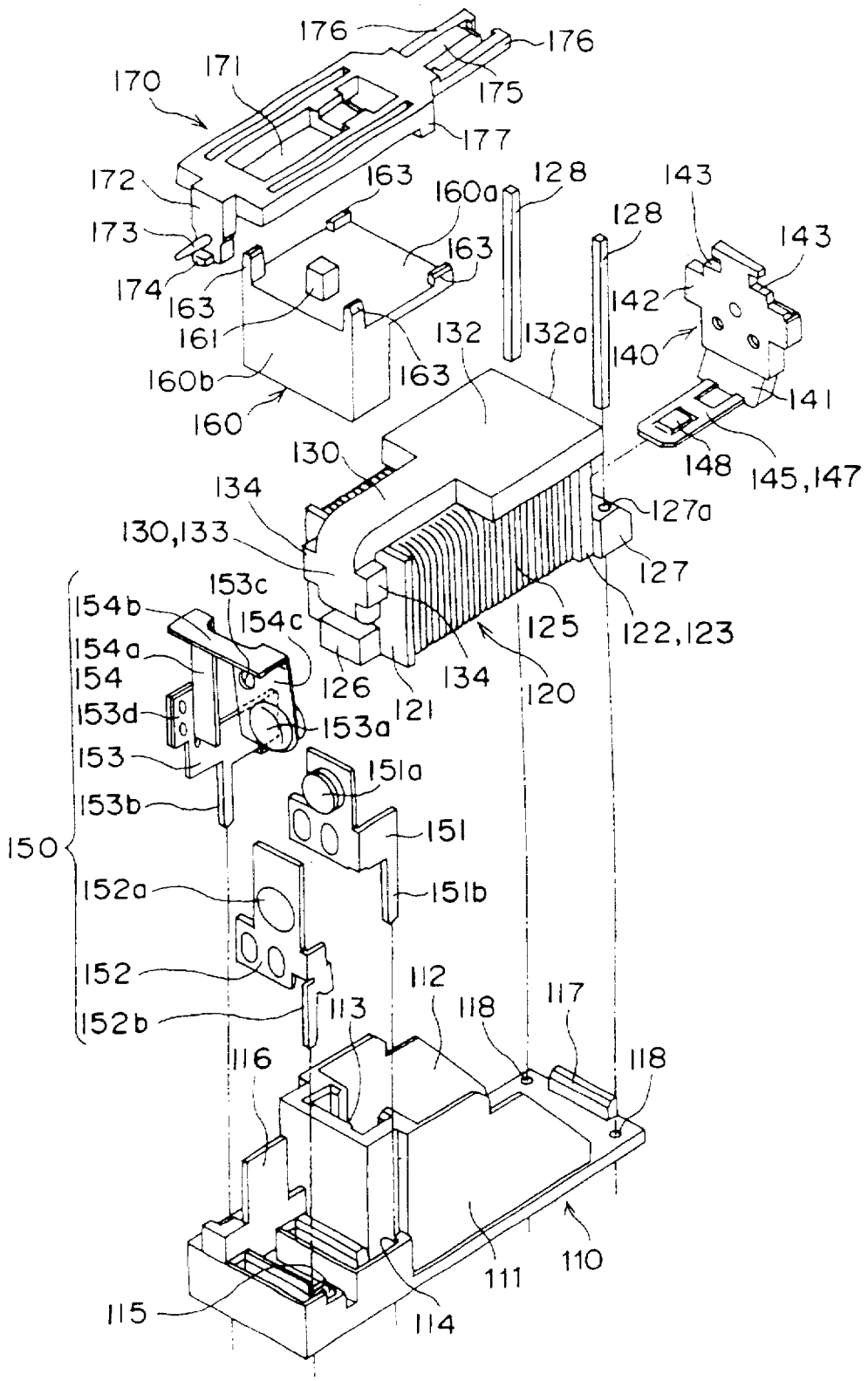
FIG. 23 is an exploded perspective view showing an eighth embodiment of the electromagnetic relay according to the present invention.

The fourth embodiment, as shown in FIG. 23, is nearly the same as the first embodiment but differs in that the elastic base portion 154*a* of the elastic contact member 154 is caulked and fixed to a mounting portion 153d of the terminal portion 153*b* so that the pressing force of the card 170 acts on the caulking member as a shear force.

According to the present embodiment, even if the elastic base portion 154*a* is formed of a thin-plate spring material, the portion fixed in caulking fashion becomes resistant to plastic deformation so that the elastic contact member 154 is free from rattling. Thus, the rocking fulcrum of the elastic vertical portion 154*c* will not move, offering an advantage that stable performance characteristics are obtained.

Figure 24:
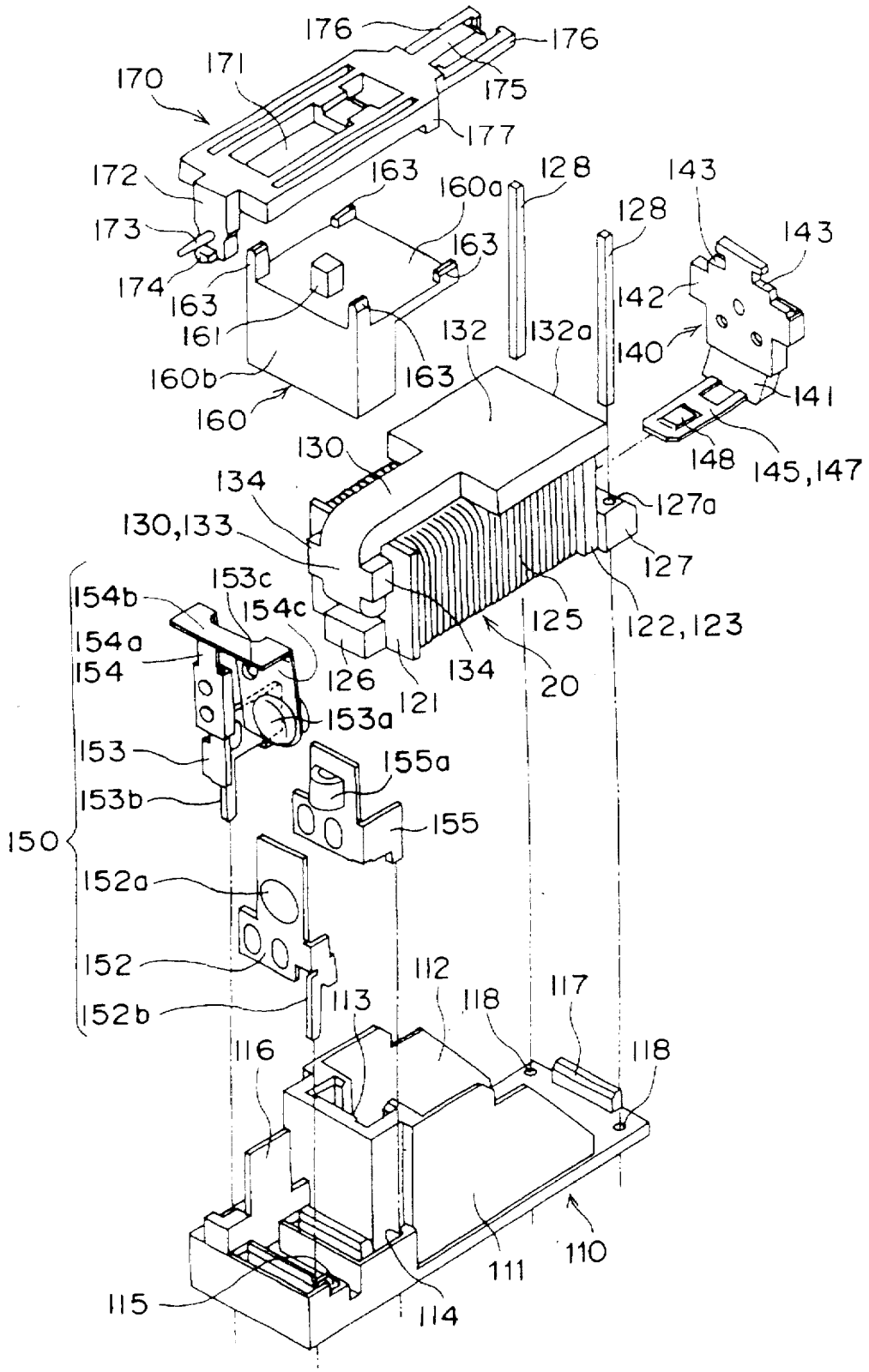
FIG. 24 is an exploded perspective view showing a ninth embodiment of the electromagnetic relay according to the present invention.
Figure 25:
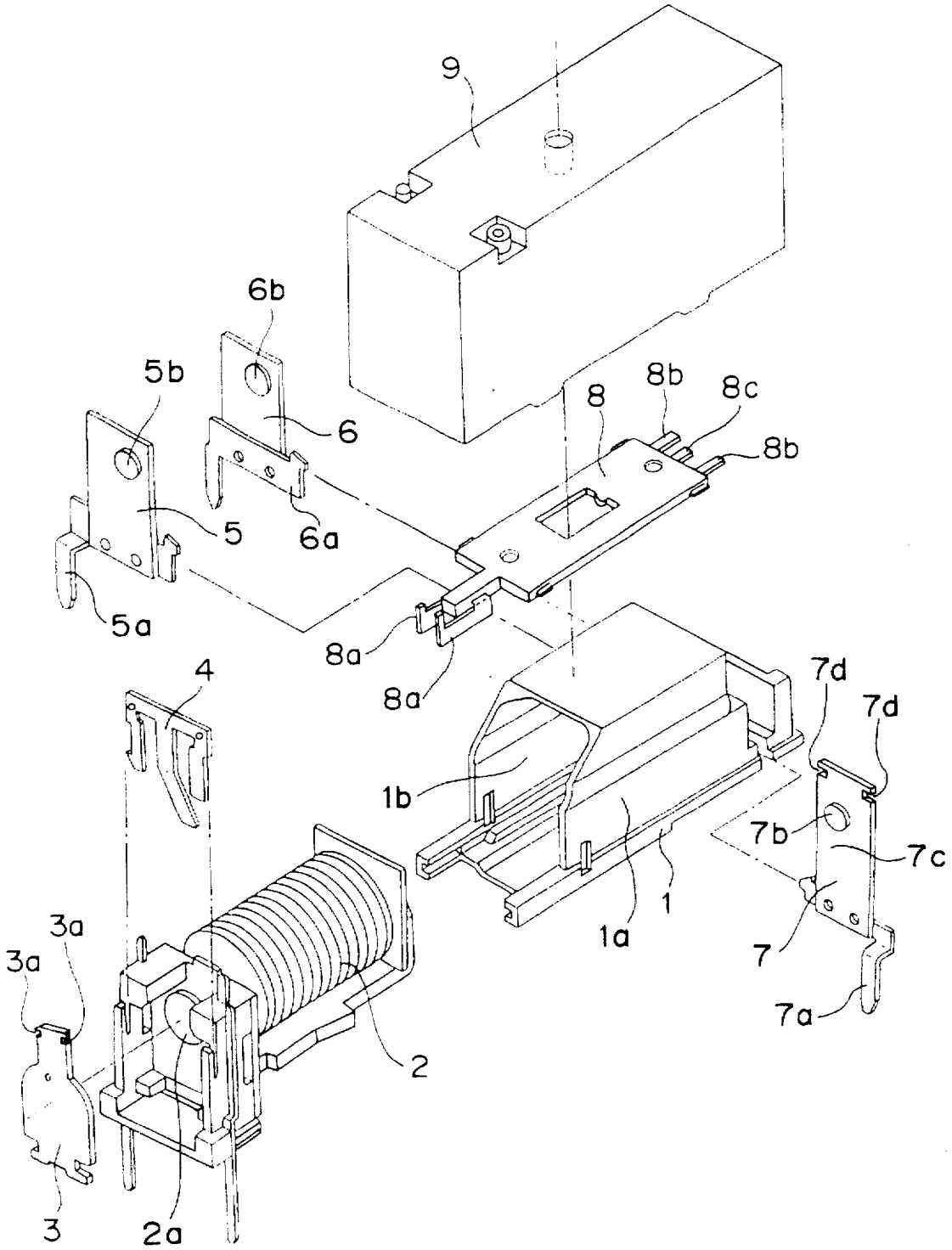
FIG. 25 is an exploded perspective view of an electromagnetic relay according to the prior art.
Figure 26:
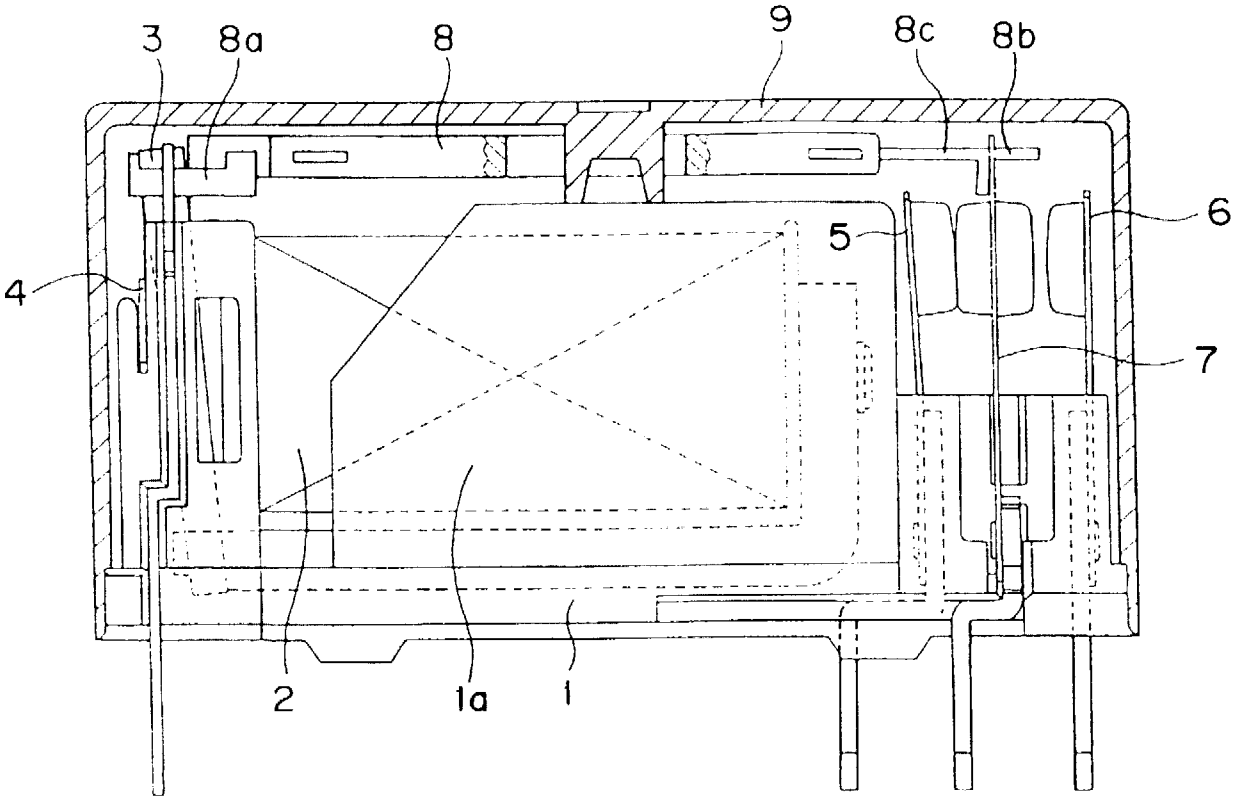
FIG. 26 is a sectional view of the electromagnetic relay according to the prior art.

The fifth embodiment, as shown in FIG. 24, has an arrangement that, whereas the aforementioned first embodiment has a normally-closed fixed contact terminal 151, a dummy fixed contact terminal 155 without terminal portions is provided instead. This dummy fixed contact terminal 155 has a dummy contact 155*a* formed by ejection process.

According to the present embodiment, by utilizing the other components except the dummy fixed contact terminal 155, there can be provided an electromagnetic relay having only a normally-open fixed contact terminal 152. Thus, an advantage that different types of electromagnetic relays can be manufactured at a low parts count is offered.

INDUSTRIAL APPLICABILITY

The above described electromagnetic relays are not limited to those having high insulating characteristic but can be applied to ordinary electromagnetic relays.

We claim:

1. An electromagnetic relay which comprises: a base having an insulating wall of a generally U-shape in its plan view molded integrally at a generally center of a top surface of the base; an electromagnet block which is formed by winding a coil around an iron core and which is located at the top surface of the base so as to be surrounded by the insulating wall on one end side thereof; a contact mechanism located on one side of the top surface of the base partitioned by the insulating wall from one end side of the electromagnet block; an insulating cover covering an upper opening of the insulating wall; and a card for driving the contact mechanism by moving reciprocatingly and axially above the insulating cover as the electromagnet block is energized and de-energized.

2. The electromagnetic relay according to claim 1, wherein the insulating cover has a generally "L"-shaped cross section, and covers at its vertical portion at least a central outer side face of the insulating wall so as to partition the electromagnet block and the contact mechanism from each other in a double structure.

3. The electromagnetic relay according to claim 1 or 2, wherein a pair of projecting portions for sandwiching end portion side faces of the core that are exposed from the electromagnet block are provided at a bottom surface of the insulating cover.

4. The electromagnetic relay according to any one of claims 1 or 2, wherein at least one projecting portion for ensuring the reciprocating movement of the card is provided in the top surface of the insulating cover so as to be in contact with the ceiling surface of a casing filled to the base.

5. The electromagnetic relay according to any one of claims 1 or 2, wherein the electromagnet block is positioned by pressing it to the base with the insulating cover having at its top surface a projecting portion which comes into press contact with the ceiling surface of a casing fitted to the base.

6. The electromagnetic relay according to any one of claims 1 or 2, wherein at least one guide projection for guiding the reciprocating movement of the card is provided at the top surface of the insulating cover.

7. The electromagnetic relay according to any one of claims 1 or 2, wherein a projecting portion for restricting the card in its position by making contact with the card that has returned to its original position is provided at the top surface of the insulating cover.

* * * * *

UNITED STATES PATENT AND TRADEMARK OFFICE
Certificate

Patent No. 5,757,255 Patented: May 26, 1998

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Masayuki Noda, Takatsuki-shi, Japan; Takashi Asao, Kusatsu-shi, Japan.

Signed and Sealed this Tenth Day of April, 2001.

MICHAEL L. GELLNER
*Supervisory Patent Examiner*
Art Unit 2832

US005757255B1

REEXAMINATION CERTIFICATE (3903rd)

United States Patent [19] [11] B1 5,757,255

Noda et al. [45] Certificate Issued Oct. 12, 1999

[54] ELECTROMAGNETIC RELAY

[75] Inventors: Masayuki Noda, Takatsuki; Takeshi Suzuki, Kyoto; Takashi Noguchi, Nagaokakyo; Tatsuo Shinoura, Takatsuki; Takashi Asao, Kusatsu, all of Japan

[73] Assignee: Omron Corporation, Kyoto, Japan

Reexamination Request:
No. 90/005,224, Jan. 20, 1999

Reexamination Certificate for:

| | |
|---|---|
| Patent No.: | **5,757,255** |
| Issued: | **May 26, 1998** |
| Appl. No.: | **08/700,456** |
| Filed: | **Sep. 11, 1996** |

[22] PCT Filed: Mar. 10, 1995

[86] PCT No.: PCT/JP95/00405

§ 371 Date: Sep. 11, 1996

§ 102(e) Date: Sep. 11, 1996

[87] PCT Pub. No.: WO95/25336

PCT Pub. Date: Sep. 21, 1995

[30] Foreign Application Priority Data

Mar. 15, 1994 [JP] Japan ..... 6-043973

[51] Int. Cl.[6] ..... H01H 51/22

[52] U.S. Cl. ..... 335/78; 335/129; 335/202

[56] References Cited

FOREIGN PATENT DOCUMENTS

| | | |
|---|---|---|
| 3441224 | 5/1986 | Germany . |
| 91 06 073 | 10/1992 | Germany . |
| 9315891 | 2/1994 | Germany . |
| 2167902 | 6/1986 | United Kingdom . |

OTHER PUBLICATIONS

North Electric Company: "North "M" type miniature relay" North Industrial Bulletin, vol. 204, No. 6, Feb. 25, 1960, Galion, Ohio XP002071448.

*Primary Examiner*—Michael L. Gellner

[57] ABSTRACT

In an electromagnetic relay in which a contact mechanism 50 provided on a base 10 is driven by a card 60 which slides and moves in parallel to the axis of an electromagnet block 20 provided in the base 10 as the electromagnet block 20 is mangetized and demagnetized. the base 10 comprises a guide portion 17 for restricting the card 60 in its position. This prevents variations in the performance characteristics so that high productivity and long service life of contact can be obtained.

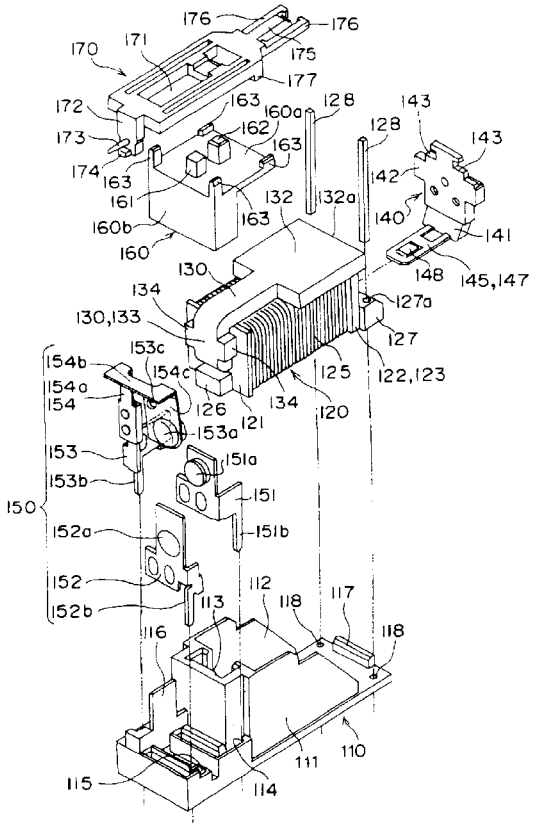

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *